US008597080B2

(12) United States Patent
Raffaelli

(10) Patent No.: US 8,597,080 B2
(45) Date of Patent: Dec. 3, 2013

(54) OPHTHALMIC ROUGHING WHEEL

(75) Inventor: Dennis R. Raffaelli, Oxford, MI (US)

(73) Assignee: Inland Diamond Products Company, Madison Heights, MI (US)

( * ) Notice: Subject to any disclaimer, the term of this patent is extended or adjusted under 35 U.S.C. 154(b) by 33 days.

(21) Appl. No.: 12/317,764

(22) Filed: Dec. 29, 2008

(65) Prior Publication Data

US 2009/0117830 A1 May 7, 2009

Related U.S. Application Data

(63) Continuation of application No. 11/731,667, filed on Mar. 30, 2007, now abandoned, which is a continuation of application No. 10/829,630, filed on Apr. 22, 2004, now abandoned.

(60) Provisional application No. 60/505,564, filed on Sep. 24, 2003.

(51) Int. Cl.
*B24B 1/00* (2006.01)
*B24D 5/10* (2006.01)

(52) U.S. Cl.
USPC ..... 451/43; 451/541; 451/547

(58) Field of Classification Search
USPC ..... 451/42–44, 488, 540–547
See application file for complete search history.

(56) References Cited

U.S. PATENT DOCUMENTS

| | | | | |
|---|---|---|---|---|
| 2,049,874 A | | 8/1933 | Sherk | |
| 3,711,999 A | | 1/1973 | Held | |
| 3,841,034 A | | 10/1974 | Held | |
| 3,916,579 A | | 11/1975 | Waller et al. | |
| 4,286,415 A | * | 9/1981 | Loreto | 451/43 |
| 4,885,875 A | * | 12/1989 | Soper | 451/43 |
| 5,053,971 A | * | 10/1991 | Wood et al. | 700/164 |
| 5,384,987 A | * | 1/1995 | Wiand | 451/41 |
| 5,611,724 A | | 3/1997 | de Graaff | |
| 5,655,958 A | | 8/1997 | Lupi | |
| 5,727,987 A | * | 3/1998 | Gottschlad | 451/5 |
| 5,846,125 A | | 12/1998 | Robichon | |
| 5,951,381 A | | 9/1999 | Videcoq et al. | |
| 6,074,278 A | | 6/2000 | Wu et al. | |
| 6,840,851 B1 | | 1/2005 | Raffaelli | |

FOREIGN PATENT DOCUMENTS

| | | |
|---|---|---|
| DE | 195 38 841 A1 | 2/1997 |
| EP | 1 518 642 A2 | 3/2005 |
| FR | 2 413 182 A | 7/1979 |
| JP | 57003561 (U) | 1/1982 |
| JP | A-52-121889 | 10/1997 |
| JP | 2000 354969 A | 12/2000 |
| WO | WO 02/26432 A | 4/2002 |

OTHER PUBLICATIONS

Krey Optical Brochure; Retrieved Sep. 18, 2003 from "www.krey-optical.com/material.htm"; 4 pages.
PPG Optical Monomers and Coatings Brochure; Retrieved Sep. 18, 2003 from "www.ppg.com/chm_optical/trivex)ppg.htm"; 3 pages.

* cited by examiner

*Primary Examiner* — Dung Van Nguyen
(74) *Attorney, Agent, or Firm* — Warn Partners, P.C.

(57) ABSTRACT

Ophthalmic rough-cut and polishing wheels having a plurality of swarf clearance grooves formed across the shaping face are described. The grooves are spaced around the shaping face of the wheels, wherein the slots are configured so as to be substantially angled either towards or away from one another.

16 Claims, 40 Drawing Sheets

OPHTHALMIC ROUGHING WHEEL

CROSS-REFERENCE TO RELATED APPLICATIONS

This application is a continuation of U.S. patent application Ser. No. 11/731,667 filed on Jul. 28, 2008 which is a continuation of U.S. patent application Ser. No. 10/829,630 filed on Apr. 22, 2004; which claims the benefit of U.S. Provisional Application No. 60/505,564, filed Sep. 24, 2003. The disclosures of the above applications are incorporated herein by reference.

FIELD OF THE INVENTION

The present invention relates generally to rough-cut and polishing wheels of the type used for edging of an optical edge. More specifically, the present invention relates to rough-cut and polishing wheels that reduce the necessary manual removal of swarf from the lens after rough cutting, fine grinding, finishing, polishing, and/or beveling of an optical lens, so as to improve lens edge quality and/or geometry.

BACKGROUND OF THE INVENTION

Optical lenses are typically made of various materials, such as polycarbonates and high index plastics, as well as those materials currently marketed under the trade names CR39® and TRIVEX™ (both readily commercially available from PPG Industries, Pittsburgh, Pa.).

In order to finish and make these lenses ready for fitting into a lens frame, it is necessary to edge the outer periphery of the lens, to give it the proper cross-section to fit in an eyeglass lens frame. Typically, this is done by an edging machine, which includes a rough-cut wheel for cutting out the shape, fine grinding and finishing wheels for further shaping of the lens, and polishing and beveling wheels for providing the final contour.

Depending on the lens material, the grinding operation creates abrasive swarf material that requires removal in order for proper use of any type of abrasive device. Typically, the wheels have buildup of swarf during the operation, which imparts itself onto the lens or, alternatively, the grinding process does not remove the excess material. This creates the need to manually remove the swarf from the lens. Any swarf that is not readily removed during the grinding of the edging operation, interferes with the operation and, at the very least, slows it down and may add to several hand finishing steps necessary at the end, or an improper lens configuration.

TRIVEX™ has been a particularly troublesome material to shape and finish. However, TRIVEX™ does appear to be a new and preferred lens making material. Unfortunately, conventional forming wheels have resulted in much scrap and have otherwise been proved to be unsuitable for use with TRIVEX™ materials for lenses. Therefore, it has become a goal to provide an abrasive wheel capable of processing TRIVEX™ lenses that can also be used for all other type of lens materials.

In the optical industry today, the "one-hour" optical labs and the like have made it necessary for increased efficiencies in the processing of optical lens production. Therefore, it is desired to eliminate swarf removal on the optical lens by hand, regardless of the material used, which is labor intensive and time consuming.

Therefore, it is a goal in the art to provide rough-cut, fine grinding, finishing, polishing and/or beveling wheels, and methods for using the same, that eliminate the need for manual swarf removal.

SUMMARY OF THE INVENTION

In accordance with one embodiment of the present invention, there is provided a rough-cutting wheel for rough cutting of an optical lens blank. The wheel comprises a hub portion that is adapted for attachment to a rotary power source. The wheel includes an outer circumferential cutting surface having a width. The outer circumferential cutting surface includes sufficient abrasive grit attached thereto to accomplish rough cutting of any conventional optical lens blank. The wheel includes a radially extending planar side portion, and in a preferred embodiment, has at least one swarf clearing groove extending at an angle to said side portion across the circumferential groove and opening into the planar side portion, which allows removal of swarf out through the planar side portion. In another preferred embodiment, each groove is preferably configured so as to be angled with respect to any adjacent groove, e.g., either angled towards or away from any adjacent groove. In a further preferred embodiment, the grooves may be present in multiple configurations, such as pairs and the like.

In accordance with another embodiment of the present invention, there is provided a polishing wheel for edge finishing of an optical lens blank. The wheel comprises a hub portion that is adapted for attachment to a rotary power source. The wheel includes an outer circumferential cutting surface having a width. The outer circumferential cutting surface includes sufficient abrasive grit attached thereto for polishing of an optical lens blank. The wheel includes a radially extending planar side portion, and in a preferred embodiment, has at least one swarf clearing groove extending at an angle to said side portion across the circumferential groove and opening into the planar side portion, which allows removal of swarf out through the planar side portion. In another preferred embodiment, each groove is preferably configured so as to be angled with respect to any adjacent groove, e.g., either angled towards or away from any adjacent groove. In a further preferred embodiment, the grooves may be present in multiple configurations, such as pairs and the like.

In accordance with a first alternative embodiment of the present invention, a rotary edging wheel for rough cutting of an optical lens is provided, comprising: (1) a hub portion operable for attachment to a rotary power source; (2) an outer circumferential rough cutting surface having a width, said surface including an abrasive grit attached thereto, wherein said abrasive grit is operable for rough cutting of the optical lens; and (3) at least one pair of substantially adjacent swarf clearing grooves formed in said surface, comprising: (a) a first swarf clearing groove extending at an angle across said surface; and (b) a second swarf clearing groove extending at an angle across said surface; wherein said first and second swarf clearing grooves are angled either towards each other or away from each other and extend continuously across said surface.

In accordance with a second alternative embodiment of the present invention, a rotary edging wheel for rough cutting of an optical lens is provided, comprising: (1) a hub portion operable for attachment to a rotary power source; (2) an outer circumferential rough cutting surface having a width, said surface including an abrasive grit attached thereto, wherein said abrasive grit is operable for rough cutting of the optical lens; (3) a first pair of substantially adjacent swarf clearing grooves formed in said surface, comprising first and second substantially parallel swarf clearing grooves extending at an angle across said surface; and (4) a second pair of substantially adjacent swarf clearing grooves formed in said surface, comprising third and fourth substantially parallel second swarf clearing grooves extending at an angle across said surface; wherein said first and second pairs of swarf clearing grooves are angled either towards each other or away from each other and extend continuously across said surface.

In accordance with a third alternative embodiment of the present invention, a rotary edging wheel for polishing of an optical lens is provided, comprising: (1) a hub portion operable for attachment to a rotary power source; (2) an outer circumferential cutting surface having a width, said surface including an abrasive grit attached thereto, wherein said abrasive grit is operable for polishing of the optical lens; and (3) at least one pair of substantially adjacent swarf clearing grooves formed in said surface, comprising: (a) a first swarf clearing groove extending at an angle across said surface; and (b) a second swarf clearing groove extending at an angle across said surface; wherein said first and second swarf clearing grooves are angled either towards each other or away from each other and extend continuously across said surface.

In accordance with a fourth alternative embodiment of the present invention, a rotary edging wheel for polishing of an optical lens is provided, comprising: (1) a hub portion operable for attachment to a rotary power source; (2) an outer circumferential cutting surface having a width, said surface including an abrasive grit attached thereto, wherein said abrasive grit is operable for polishing of the optical lens; (3) a first pair of substantially adjacent swarf clearing grooves formed in said surface, comprising first and second substantially parallel swarf clearing grooves extending at an angle across said surface; and (4) a second pair of substantially adjacent swarf clearing grooves formed in said surface, comprising third and fourth substantially parallel second swarf clearing grooves extending at an angle across said surface; wherein said first and second pairs of swarf clearing grooves are angled either towards each other or away from each other and extend continuously across said surface.

In accordance with a fifth alternative embodiment of the present invention, a method for rough cutting of an optical lens is provided, comprising: (1) providing an edging wheel, comprising: (a) a hub portion operable for attachment to a rotary power source; (b) an outer circumferential rough cutting surface having a width, said surface including an abrasive grit attached thereto, wherein said abrasive grit is operable for rough cutting of the optical lens; and (c) at least one pair of substantially adjacent swarf clearing grooves formed in said surface, comprising: (i) a first swarf clearing groove extending at an angle across said surface; and (ii) a second swarf clearing groove extending at an angle across said surface; wherein said first and second swarf clearing grooves are angled either towards each other or away from each other and extend continuously across said surface; (2) selectively rotating said edging wheel; and (3) bringing the optical lens into selective contact with said rotating edging wheel.

In accordance with a sixth alternative embodiment of the present invention, a method for rough cutting of an optical lens is provided, comprising: (1) providing a rotary edging wheel, comprising: (a) a hub portion operable for attachment to a rotary power source; (b) an outer circumferential rough cutting surface having a width, said surface including an abrasive grit attached thereto, wherein said abrasive grit is operable for rough cutting of the optical lens; (c) a first pair of substantially adjacent swarf clearing grooves formed in said surface, comprising first and second substantially parallel swarf clearing grooves extending at an angle across said surface; and (d) a second pair of substantially adjacent swarf clearing grooves formed in said surface, comprising third and fourth substantially parallel second swarf clearing grooves extending at an angle across said surface; wherein said first and second pairs of swarf clearing grooves are angled either towards each other or away from each other and extend continuously across said surface; (2) selectively rotating said edging wheel; and (3) bringing the optical lens into selective contact with said rotating edging wheel.

In accordance with a seventh alternative embodiment of the present invention, a method for polishing of an optical lens is provided, comprising: (1) providing a rotary edging wheel, comprising: (a) a hub portion operable for attachment to a rotary power source; (b) an outer circumferential cutting surface having a width, said surface including an abrasive grit attached thereto, wherein said abrasive grit is operable for polishing of the optical lens; and (c) at least one pair of substantially adjacent swarf clearing grooves formed in said surface, comprising: (i) a first swarf clearing groove extending at an angle across said surface; and (ii) a second swarf clearing groove extending at an angle across said surface; wherein said first and second swarf clearing grooves are angled either towards each other or away from each other and extend continuously across said surface; (2) selectively rotating said edging wheel; and (3) bringing the optical lens into selective contact with said rotating edging wheel.

In accordance with an eighth alternative embodiment of the present invention, a method for polishing an optical lens is provided, comprising: (1) providing a rotary edging wheel, comprising: (a) a hub portion operable for attachment to a rotary power source; (b) an outer circumferential cutting surface having a width, said surface including an abrasive grit attached thereto, wherein said abrasive grit is operable for polishing of the optical lens; (c) a radially extending planar side portion; (d) a first pair of substantially adjacent swarf clearing grooves formed in said surface, comprising first and second substantially parallel swarf clearing grooves extending at an angle across said surface; and (e) a second pair of substantially adjacent swarf clearing grooves formed in said surface, comprising third and fourth substantially parallel second swarf clearing grooves extending at an angle across said surface; wherein said first and second pairs of swarf clearing grooves are angled either towards each other or away from each other and extend continuously across said surface; (2) selectively rotating said edging wheel; and (3) bringing the optical lens into selective contact with said rotating edging wheel.

A further understanding of the present invention will be had in view of the description of the drawings and detailed description of the invention, when viewed in conjunction with the subjoined claims.

BRIEF DESCRIPTION OF THE DRAWINGS

The same reference numerals refer to the same parts throughout the various Figures.

DETAILED DESCRIPTION OF THE PREFERRED EMBODIMENTS

Although the following description primary concerns rough cutting and polishing wheels for use with optical lens blanks, it should be appreciated that the present invention can be practiced with any type of surfacing wheel wherein removal of swarf material is desirable. For example, the present invention can be applied to any number of types of surfacing wheels, such as but not limited to rough cutting wheels, fine grinding wheels, finishing wheels, polishing wheels, beveling wheels, and the like. Additionally, the present invention can be practiced with any type of optical lens blank material, such but not limited to polycarbonates and high index plastics, as well as those materials currently marketed under the trade names CR39® and TRIVEX™.

Figure 1:
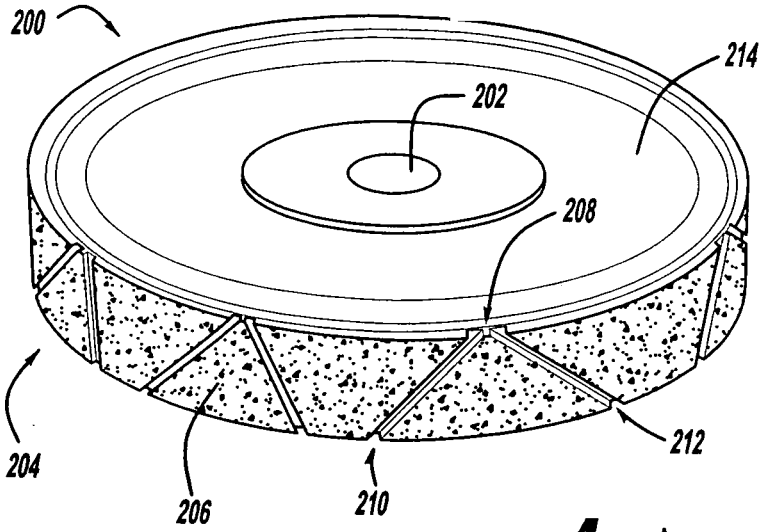
FIG. 1 is a perspective view of a roughing wheel, in accordance with a first embodiment of the present invention.
Figure 2:
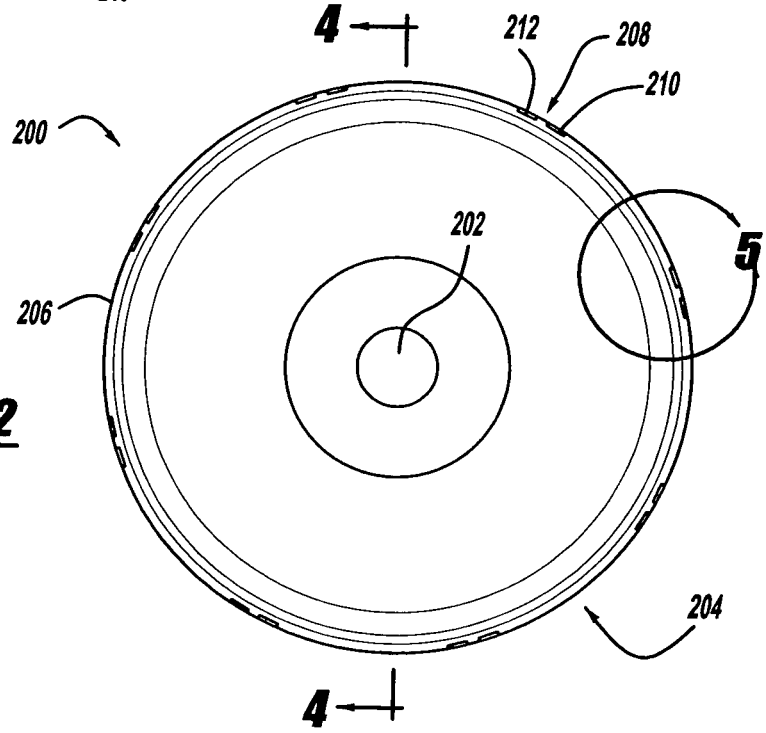
FIG. 2 is an elevational view of the roughing wheel depicted in FIG. 1, in accordance with the first embodiment of the present invention.
Figure 3:
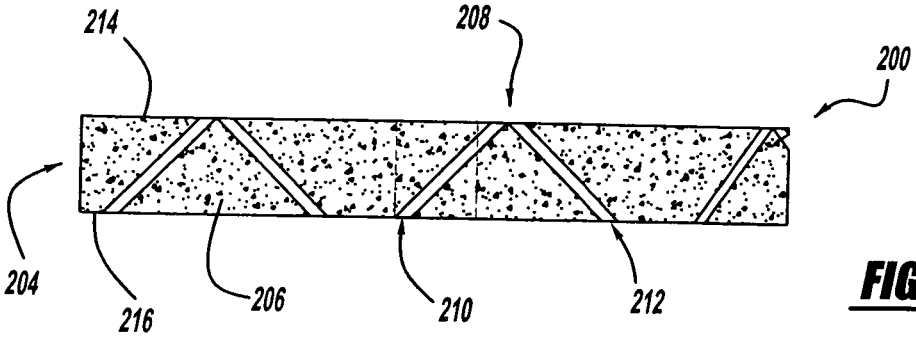
FIG. 3 is a top view of the roughing wheel depicted in FIGS. 1 and 2, in accordance with the first embodiment of the present invention.
Figure 4:
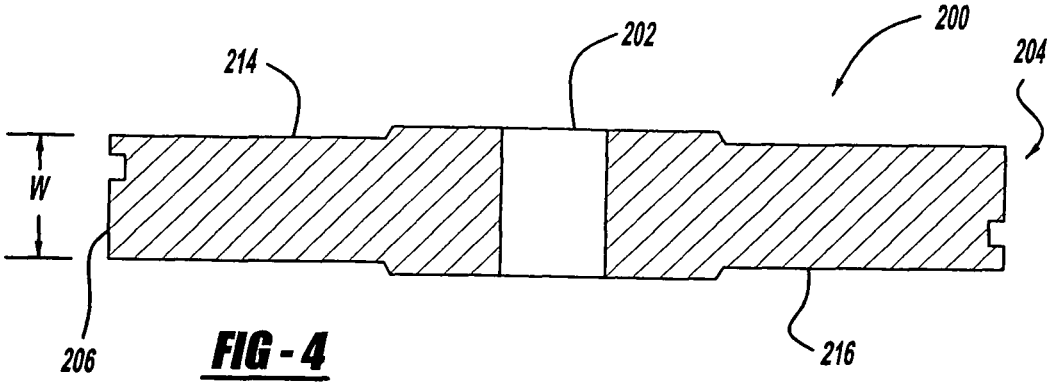
FIG. 4 is a sectional plan view taken along line 4-4 of FIG. 2 of the roughing wheel depicted in FIGS. 1-3, in accordance with the first embodiment of the present invention.
Figure 5:
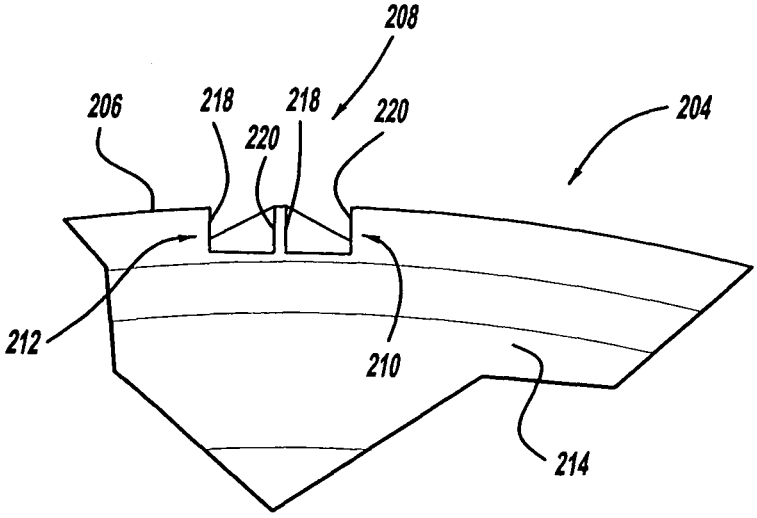
FIG. 5 is a detailed side view illustrating the swarf-clearing groove of the roughing wheel depicted in FIGS. 1-4, in accordance with the first embodiment of the present invention.

In accordance with a first embodiment of the present invention, there is provided a rough cutting wheel generally shown at 200 for rough cutting of an optical lens, as shown in FIGS. 1-5. The rough cutting wheel 200 preferably includes a hub portion generally indicated at 202 and an outer circumferential cutting surface generally indicated at 204. The cutting surface 204 includes a width W and includes an abrasive grit material 206 that is preferably attached thereto for rough cutting of the lens.

The exact grit rating of the abrasive grit material 206 is not thought to be critical to the success of the present invention, provided that the abrasive grit material 206 of the present invention is operable to rough cut any conventional optical lens materials, such as but not limited to polycarbonates and high index plastics, as well as those materials currently marketed under the trade names CR39® and TRIVEX™. In accordance with a preferred embodiment of the present invention, the grit rating of the abrasive grit material 206 is preferably in the range of about 20 to about 80, more preferably in the range of about 60 to about 80, and still more preferably in the range of about 60 to about 70. It should be appreciated that grit rating outside of these ranges, i.e., less than 20 and/or greater than 80, may be used as well in the practice of the present invention, should circumstances require (e.g., material specific requirements).

Preferably, the abrasive grit material 206 is attached by brazing the abrasive grit onto the cutting surface 204 of the wheel 200. However, the abrasive grit material 206 may also be attached to the cutting surface 204 by sintering electroplating or resin bonding. The abrasive grit material 206 is preferably comprised of a diamond-like hardness abrasive grit. However, other materials such as silicon carbides, tungsten carbides, oxides, garnets, cubic boron nitride, and natural and synthetic diamonds may be used alone or in combination in the present invention.

In accordance with a preferred embodiment of the present invention, the wheel 200 includes at least one pair 208 of substantially adjacent swarf-clearing grooves 210, 212, respectively, that extend across the width W of the surface cutting 204, i.e., are contiguous from a first outer planar surface 214 to a second spaced and opposed outer planar surface 216 of the wheel 200. The grooves 210, 212, respectively, preferably form a chevron or chevron-like configuration.

By "pair," as that term is used herein, it is meant two or more swarf-clearing grooves. By "adjacent," as that term is used herein, it is meant two or more swarf-clearing grooves that are in relative proximity to one another. It should be appreciated that several and/or a plurality of pairs of adjacent swarf-clearing grooves may be employed in the practice of the present invention. The intended purpose of the swarf-clearing grooves 210, 212, respectively, is for removal or swarf during rough cutting of the lens.

The exact dimensions of the grooves 210, 212, respectively, are not thought to be critical to the success of the present invention provided that they do not hamper the swarf removal process. In accordance with a preferred embodiment of the present invention, the width and/or depth of either of the grooves 210, 212, respectively, is in the range of about 1 to about 10 millimeters. In accordance with a preferred embodiment of the present invention, the length of either of the grooves 210, 212, respectively, is in the range of about 1 to about 35 and preferably 20-30 millimeters. However, it should be appreciated that the width, depth, and/or length of the grooves of the present invention can be modified without departing from the scope of the present invention.

In accordance with a preferred embodiment of the present invention, multiple numbers of grooves are employed in the practice of the present invention. In accordance with a more preferred embodiment of the present invention, at least two to at least twenty grooves can be employed. In accordance with a highly preferred embodiment of the present invention, at least six to at least sixteen grooves are employed.

The exact spacing and distribution of the grooves 210, 212, respectively, are not thought to be critical to the success of the present invention provided that they do not hamper the swarf removal process. In accordance with a preferred embodiment of the present invention, about one-half to about three grooves are provided for per inch of the cutting surface 204.

In accordance with a preferred embodiment of the present invention, the surface area of the wheel that comprises the groove area is preferably in the range of about 6% to about 60%, and more preferably in the range of about 20% to about 30%.

The grooves 210, 212, are preferably configured so as to be either angled towards and/or angled away from one another. By way of a non-limiting example, each of the grooves 210, 212, respectively, can be angled from about 20 degrees to about 165 degrees in relation to either outer planar surface 214, 216, respectively. In accordance with a preferred embodiment of the present invention, each of the grooves 210, 212, respectively, can be angled from about 1 degree to about 89 degrees and/or from about 91 degrees to about 179 degrees in relation to either outer planar surface 214, 216, respectively. In accordance with a more preferred embodiment of the present invention, each of the grooves 210, 212, respectively, can be angled from about 70 degrees to about 100 degrees in relation to either outer planar surface 214, 216, respectively.

In accordance with a preferred embodiment of the present invention, each of the grooves 210, 212, respectively, can be angled from about 10 degrees to about 80 degrees in relation to either outer planar surface 214, 216, respectively. In accordance with a more preferred embodiment of the present invention, each of the grooves 210, 212, respectively, can be angled from about 15 degrees to about 65 degrees in relation to either outer planar surface 214, 216, respectively. In accordance with a highly preferred embodiment of the present invention, each of the grooves 210, 212, respectively, can be angled from about 35 degrees to about 45 degrees in relation to either outer planar surface 214, 216, respectively.

Regardless of the angle chosen, each groove 210, 212, respectively, should preferably have the same angle, e.g., if groove 210 is angled 45 degrees away from outer planar surface 214, then groove 212 should also be angled 45 degrees away from outer planar surface 214 in the same and/or opposite orientation. In accordance with a preferred embodiment of the present invention, each groove is a mirror image of the other spaced and opposed groove.

Each of the grooves 210, 212, respectively, preferably has planar sides 218, 220, respectively, that extend substantially perpendicular to either outer planar surfaces 214, 216, respectively.

Rough cutting wheels made in accordance with the present invention are readily used in rough cutting, finishing, and/or polishing machines such as those made by Wernicke & Company (Concord, Canada), Brio, Essilor, Nidek, and Indo, for example. Such machines are readily known to those skilled in the art, as well as their operation.

Figure 6:
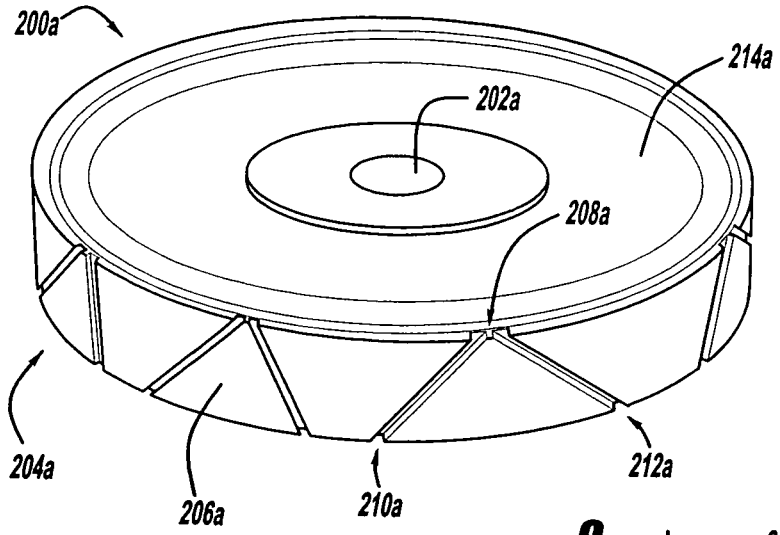
FIG. 6 is a perspective view of a polishing wheel, in accordance with a second embodiment of the present invention.
Figure 7:
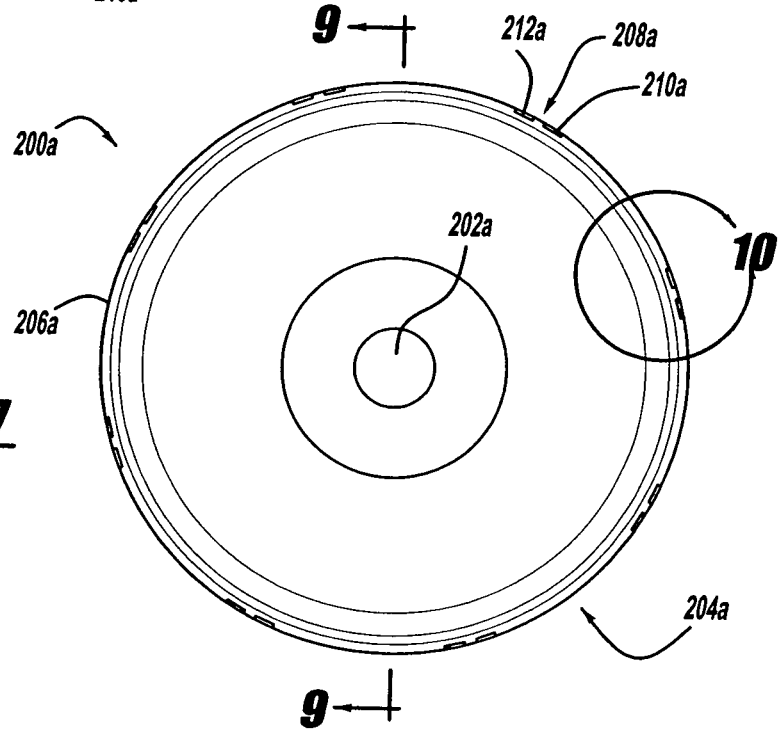
FIG. 7 is an elevational view of the polishing wheel depicted in FIG. 6, in accordance with the second embodiment of the present invention.
Figure 8:
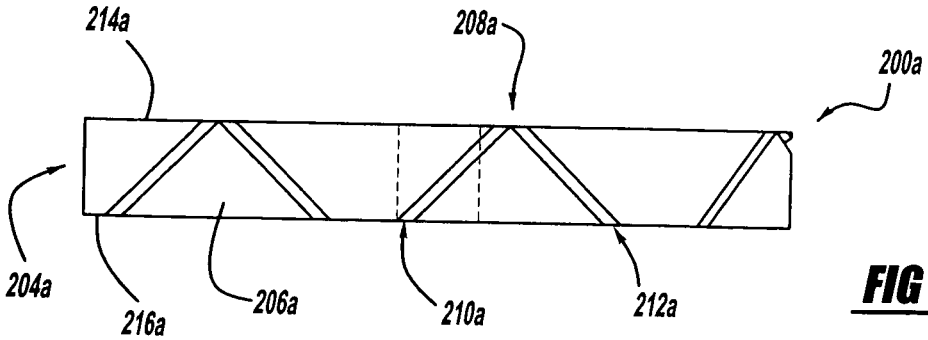
FIG. 8 is a top view of the polishing wheel depicted in FIGS. 6 and 7, in accordance with the second embodiment of the present invention.
Figure 9:
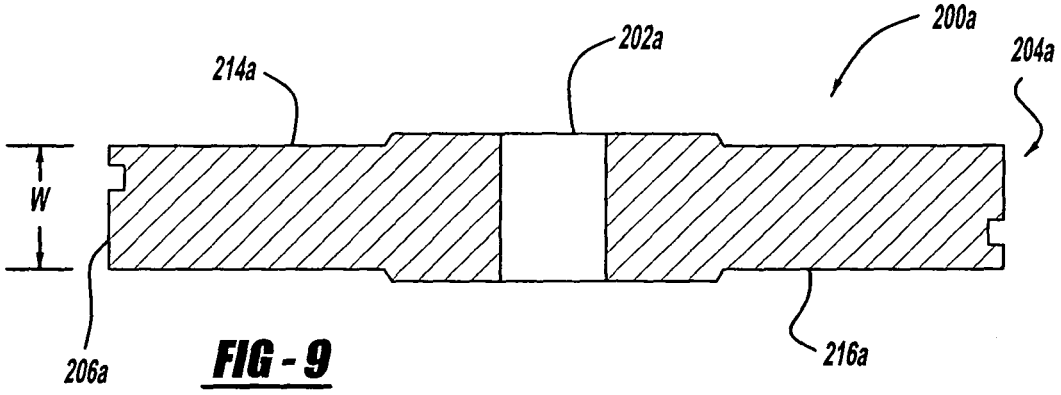
FIG. 9 is a sectional plan view taken along line 9-9 of FIG. 7 of the polishing wheel depicted in FIGS. 6-8, in accordance with the second embodiment of the present invention.
Figure 10:
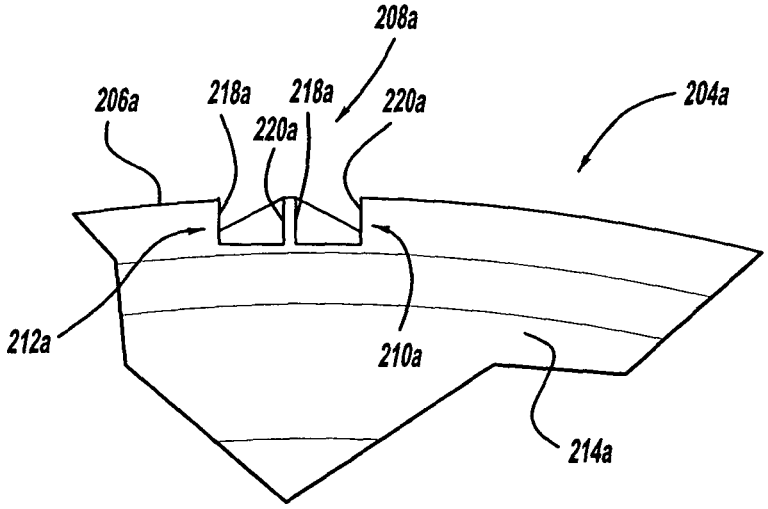
FIG. 10 is a detailed side view illustrating the swarf-clearing groove of the polishing roughing wheel depicted in FIGS. 6-9, in accordance with the second embodiment of the present invention.

In accordance with a second embodiment of the present invention, there is provided a polishing wheel generally shown at 200*a* for polishing of an optical lens, as shown in FIGS. 6-10. Again, the intended purpose of the polishing wheel 200*a* is to, among other things, facilitate the removal of swarf material.

The polishing wheel 200*a* is similar to the rough cutting wheel 200 shown in FIGS. 1-5, e.g., it includes a hub portion 202*a*, an outer circumferential cutting surface 204*a* (having a width W), an abrasive grit material 206*a*, at least one pair 208*a* of substantially adjacent swarf-clearing grooves 210*a*, 212*a*, respectively, that extend across the width W of the cutting surface 204*a*, i.e., are contiguous from a first outer planar surface 214*a* to a second spaced and opposed outer planar surface 216*a* of the wheel 200*a*, wherein each of the grooves 210*a*, 212*a*, respectively, preferably has planar sides 218*a*, 220*a*, respectively, that extend substantially perpendicular to either outer planar surfaces 214*a*, 216*a*, respectively.

However, because the polishing wheel 200*a* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*a* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

Figure 11:
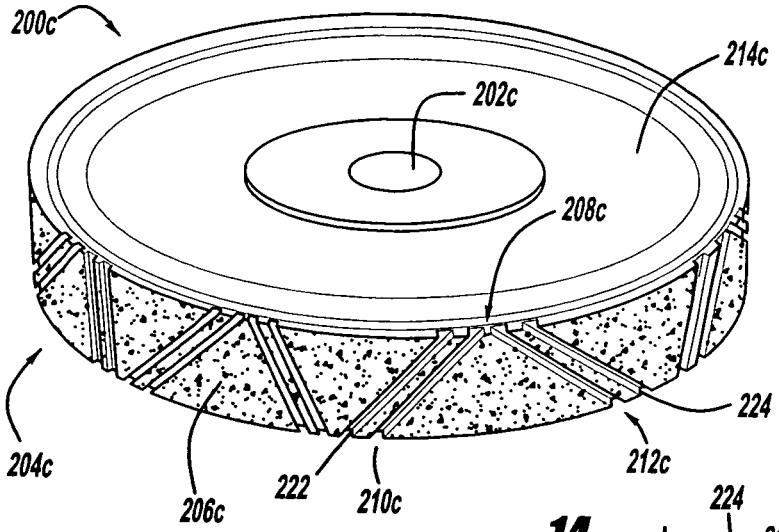
FIG. 11 is a perspective view of a first alternative roughing wheel, in accordance with a third embodiment of the present invention.
Figure 12:
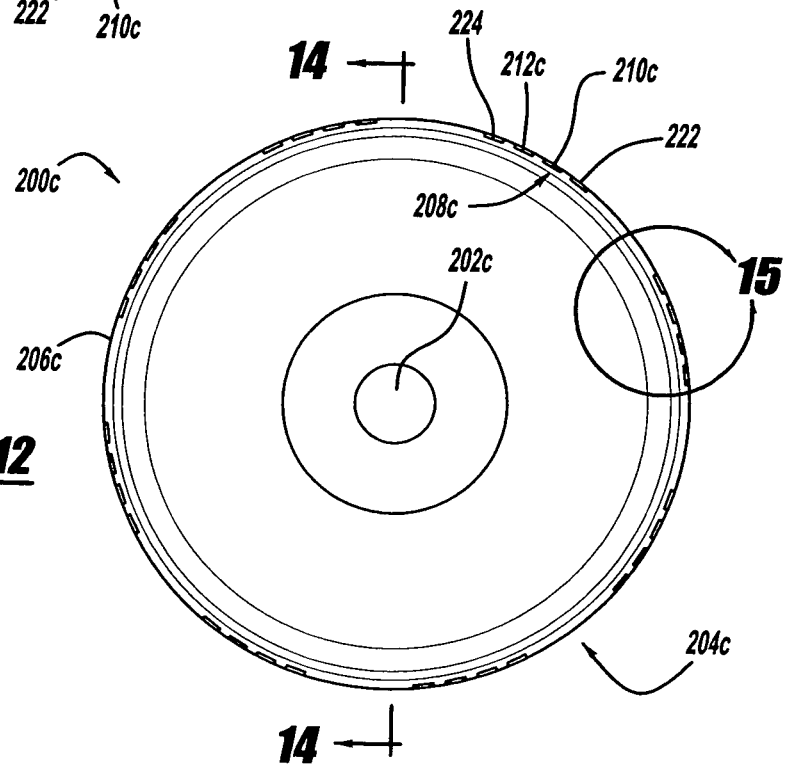
FIG. 12 is an elevational view of the first alternative roughing wheel depicted in FIG. 11, in accordance with the third embodiment of the present invention.
Figure 13:
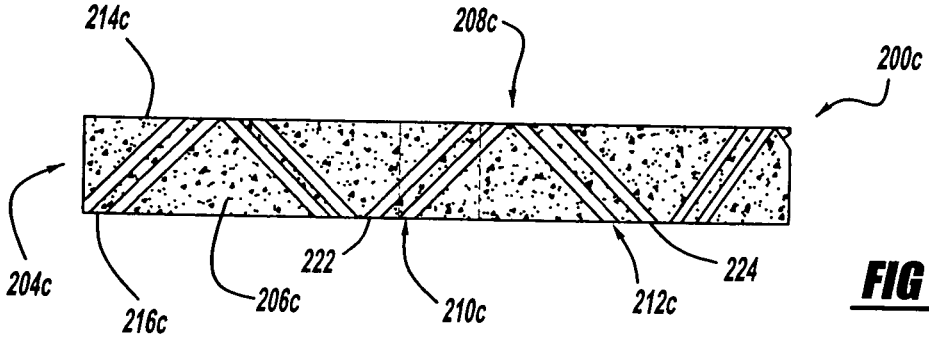
FIG. 13 is a top view of the first alternative roughing wheel depicted in FIGS. 11 and 12, in accordance with the third embodiment of the present invention.
Figure 14:
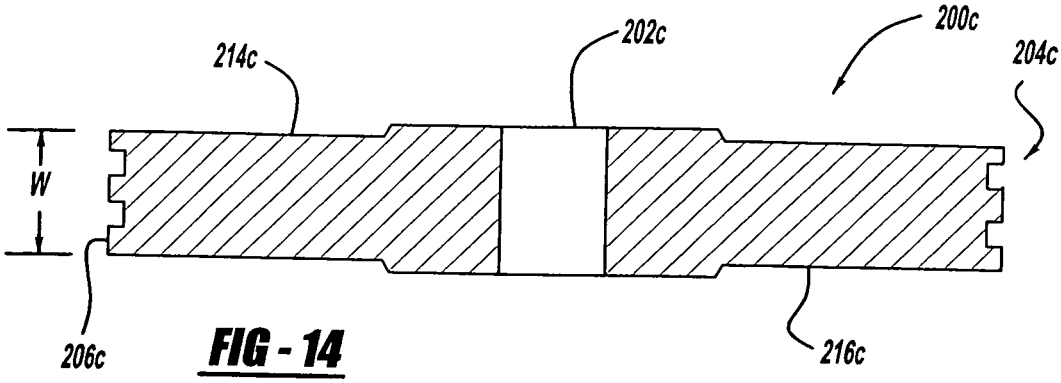
FIG. 14 is a sectional plan view taken along line 14-14 of FIG. 12 of the first alternative roughing wheel depicted in FIGS. 11-13, in accordance with the third embodiment of the present invention.
Figure 15:
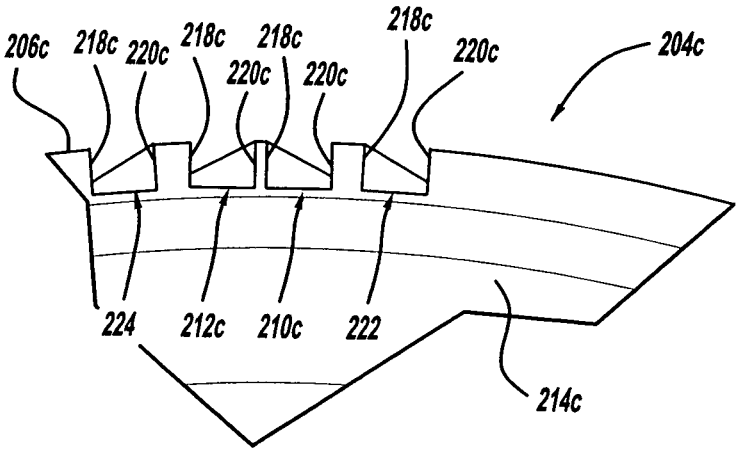
FIG. 15 is a detailed side view illustrating the swarf-clearing groove of the first alternative roughing wheel depicted in FIGS. 11-14, in accordance with the third embodiment of the present invention.

In accordance with a third embodiment of the present invention, there is provided a first alternative rough cutting wheel generally shown at 200*c* for rough cutting of an optical lens, as shown in FIGS. 11-15. Again, the intended purpose of the rough cutting wheel 200*c* is to, among other things, facilitate the removal of swarf material.

The rough cutting wheel 200*c* is similar to the rough cutting wheel 200 shown in FIGS. 1-5, e.g., it includes a hub portion 202*c*, an outer circumferential cutting surface 204*c* (having a width W), an abrasive grit material 206*c*, at least one pair 208*c* of substantially adjacent swarf-clearing grooves 210*c*, 212*c*, respectively, that extend across the width W of the cutting surface 204*c*, i.e., are contiguous from a first outer planar surface 214*c* to a second spaced and opposed outer planar surface 216*c* of the wheel 200*c*, wherein each of the grooves 210*c*, 212*c*, respectively, preferably has planar sides 218*c*, 220*c*, respectively, that extend substantially perpendicular to either outer planar surfaces 214*c*, 216*c*, respectively.

However, this embodiment differs in that two additional swarf-clearing grooves 222 and 224, respectively are provided in proximity to grooves 210*c*, 212*c*, respectively.

Figure 16:
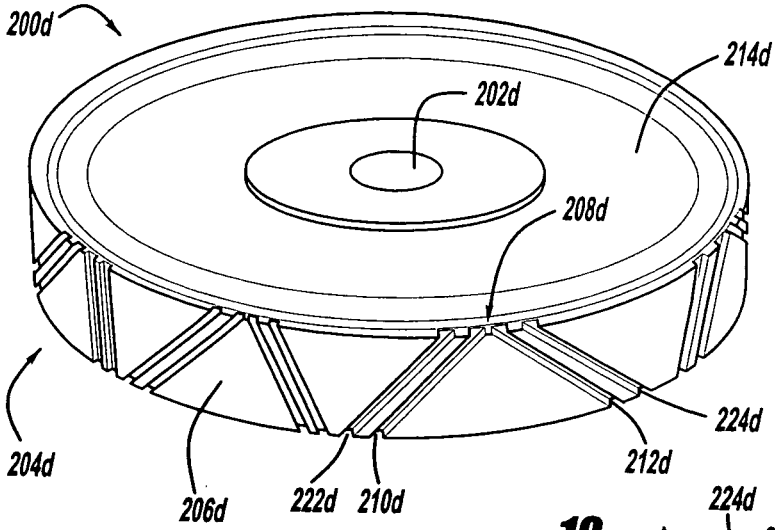
FIG. 16 is a perspective view of a first alternative polishing wheel, in accordance with a fourth embodiment of the present invention.
Figure 17:
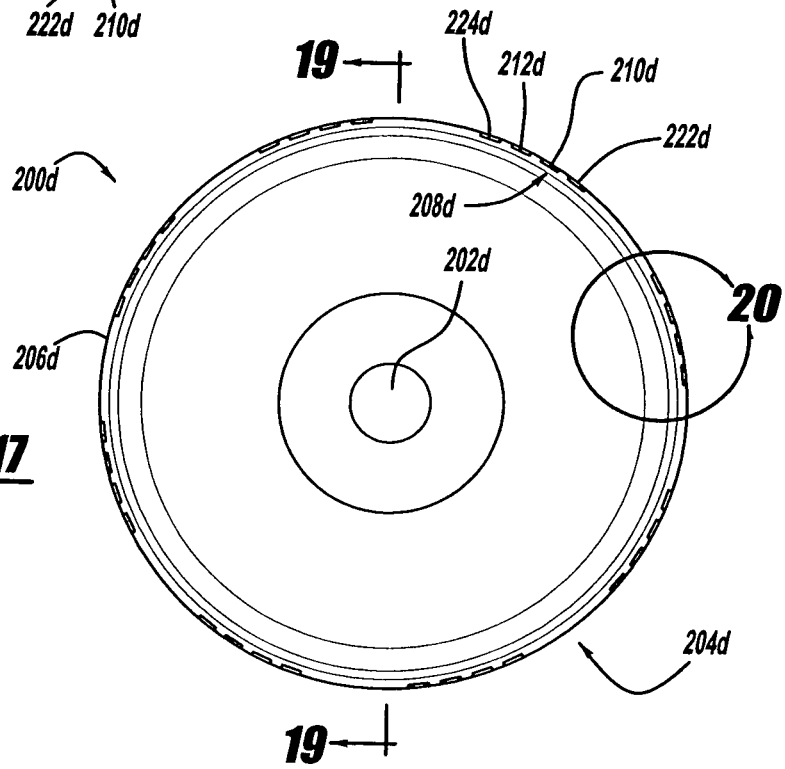
FIG. 17 is an elevational view of the first alternative polishing wheel depicted in FIG. 16, in accordance with the fourth embodiment of the present invention.
Figure 18:
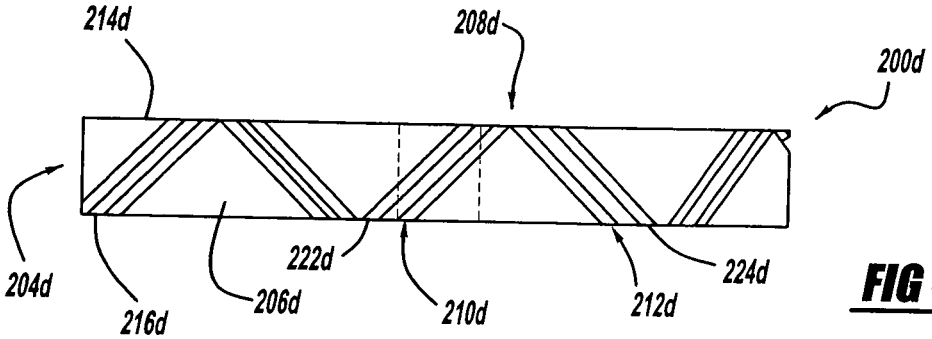
FIG. 18 is a top view of the first alternative polishing wheel depicted in FIGS. 16 and 17, in accordance with the fourth embodiment of the present invention.
Figure 19:
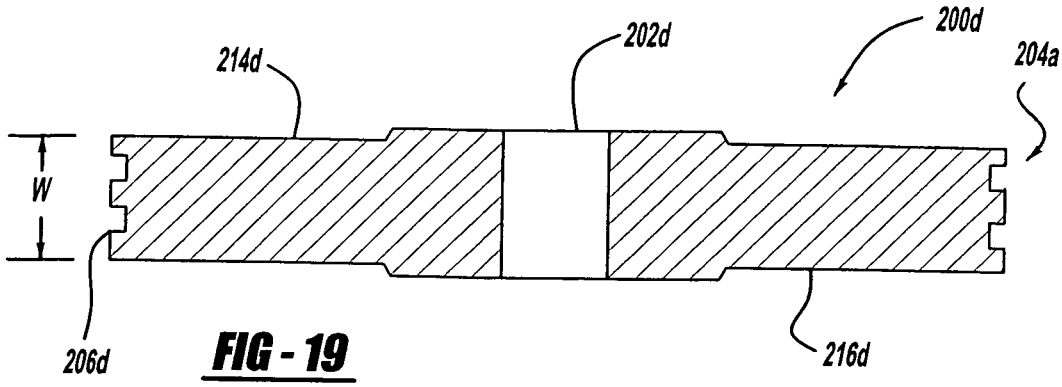
FIG. 19 is a sectional plan view taken along line 19-19 of FIG. 17 of the first alternative polishing wheel depicted in FIGS. 16-18, in accordance with the fourth embodiment of the present invention.
Figure 20:
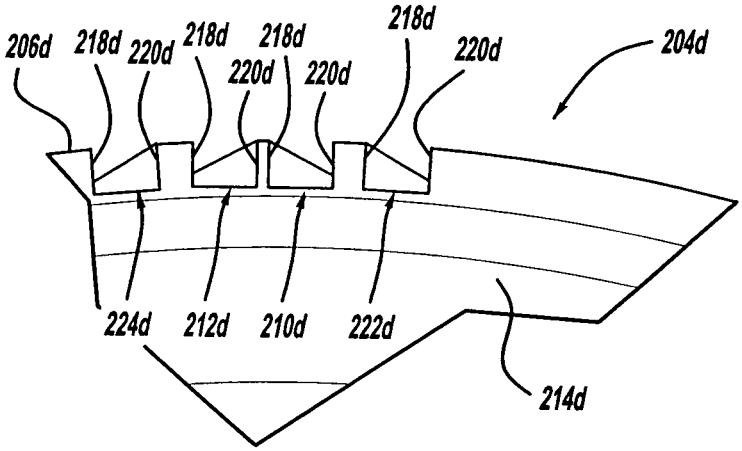
FIG. 20 is a detailed side view illustrating the swarf-clearing groove of the first alternative polishing wheel depicted in FIGS. 16-19, in accordance with the fourth embodiment of the present invention.

In accordance with a fourth embodiment of the present invention, there is provided a first alternative polishing wheel generally shown at 200*d* for polishing of an optical lens, as shown in FIGS. 16-20. Again, the intended purpose of the polishing wheel 200*d* is to, among other things, facilitate the removal of swarf material.

The polishing wheel 200*d* is similar to the rough cuffing wheel 200*c* shown in FIGS. 11-15, e.g., it includes a hub portion 202*d*, an outer circumferential cutting surface 204*d* (having a width W), an abrasive grit material 206*d*, at least one pair 208*d* of substantially adjacent swarf-clearing grooves 210*d*, 212*d*, 222*d*, 224*d*, respectively, that extend across the width W of the cutting surface 204*d*, i.e., are contiguous from a first outer planar surface 214*d* to a second spaced and opposed outer planar surface 216*d* of the wheel 200*d*, wherein each of the grooves 210*d*, 212*d*, 222*d*, 224*d*, respectively, preferably has planar sides 218*d*, 220*d*, respectively, that extend substantially perpendicular to either outer planar surfaces 214*d*, 216*d*, respectively.

However, as with the embodiment shown in FIGS. 6-10, because the polishing wheel 200*d* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*d* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

Figure 21:
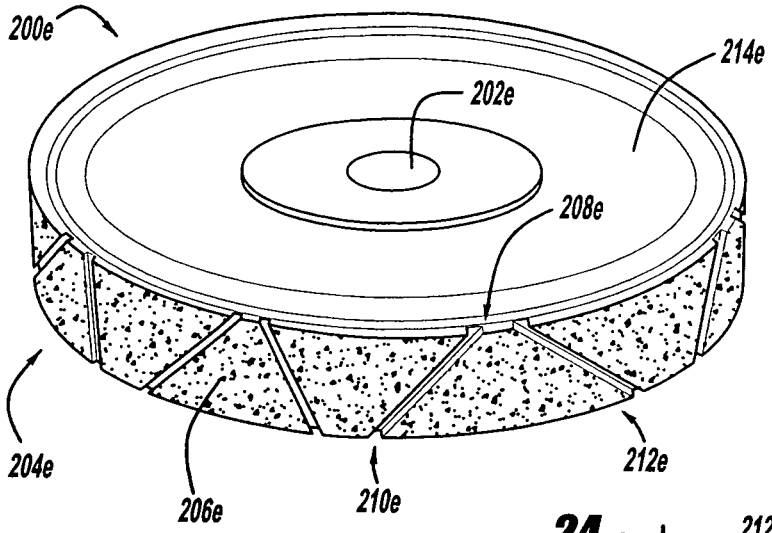
FIG. 21 is a perspective view of a second alternative roughing wheel, in accordance with a fifth embodiment of the present invention.
Figure 22:
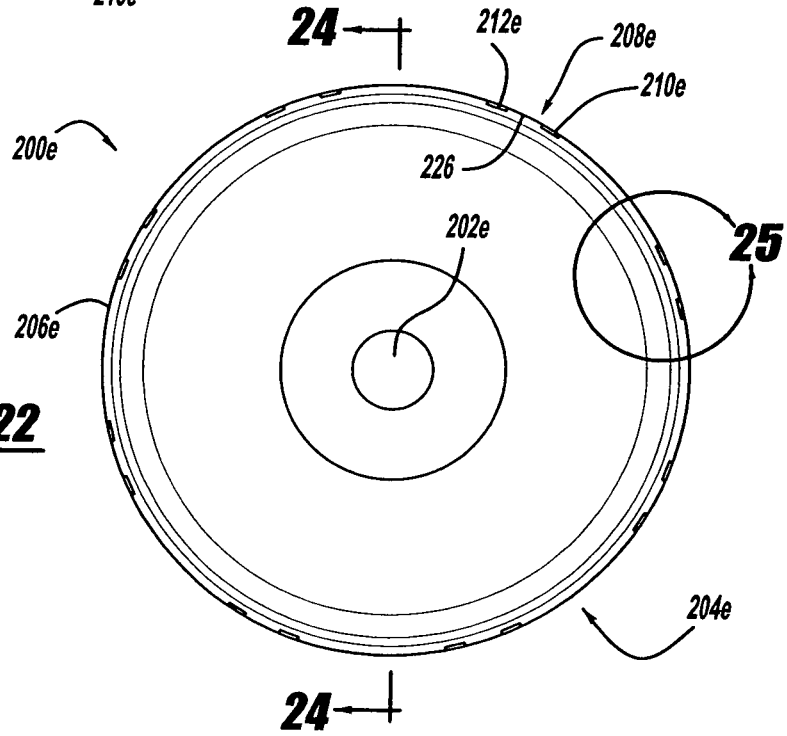
FIG. 22 is an elevational view of the second alternative roughing wheel depicted in FIG. 21, in accordance with the fifth embodiment of the present invention.
Figure 23:
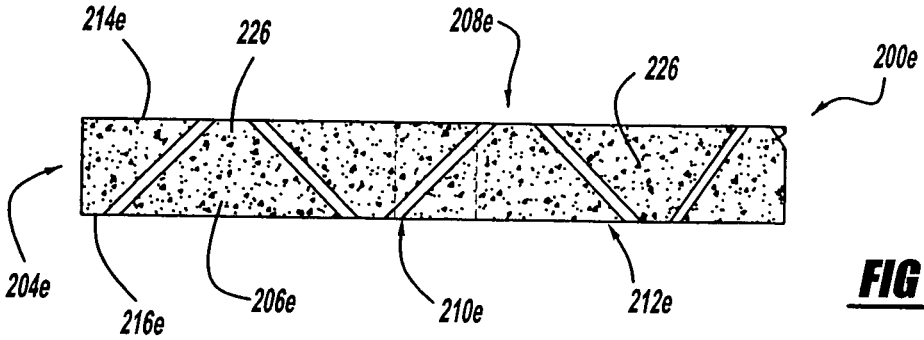
FIG. 23 is a top view of the second alternative roughing wheel depicted in FIGS. 21 and 22, in accordance with the fifth embodiment of the present invention.
Figure 24:
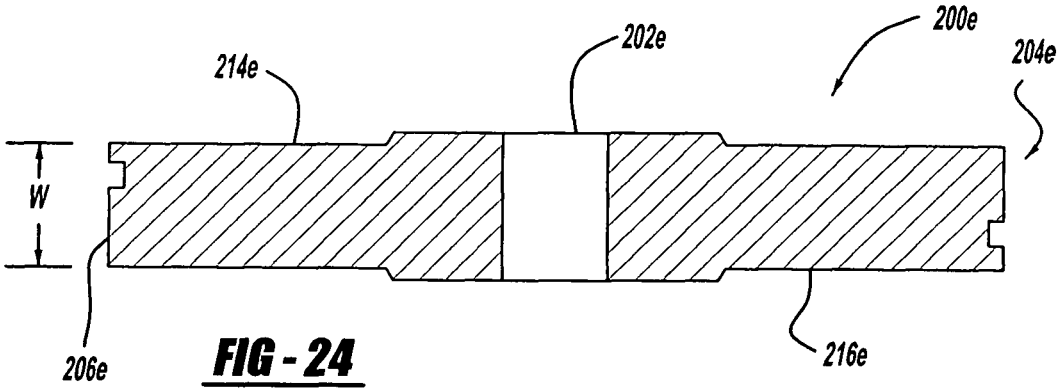
FIG. 24 is a sectional plan view taken along line 24-24 of FIG. 22 of the second alternative roughing wheel depicted in FIGS. 21-23, in accordance with the fifth embodiment of the present invention.
Figure 25:
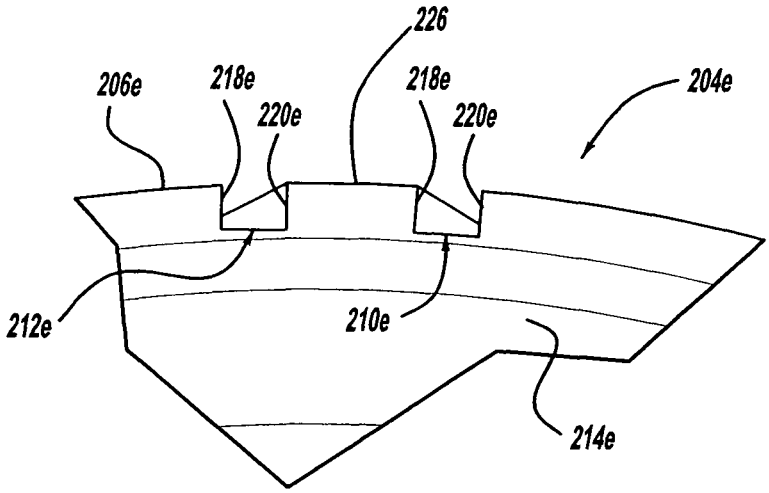
FIG. 25 is a detailed side view illustrating the swarf-clearing groove of the second alternative roughing wheel depicted in FIGS. 21-24, in accordance with the fifth embodiment of the present invention.

In accordance with a fifth embodiment of the present invention, there is provided a second alternative rough cutting wheel generally shown at 200*e* for rough cutting of an optical lens, as shown in FIGS. 21-25. Again, the intended purpose of the rough cutting wheel 200*e* is to, among other things, facilitate the removal of swarf material.

The rough cutting wheel 200*e* is similar to the rough cutting wheel 200 shown in FIGS. 1-5, e.g., it includes a hub portion 202*e*, an outer circumferential cutting surface 204*e* (having a width W), an abrasive grit material 206*e*, at least one pair 208*e* of substantially adjacent swarf-clearing grooves 210*e*, 212*e*, respectively, that extend across the width W of the cutting surface 204*e*, i.e., are contiguous from a first outer planar surface 214*e* to a second spaced and opposed outer planar surface 216*e* of the wheel 200*e*, wherein each of the grooves 210*e*, 212*e*, respectively, preferably has planar sides 218*e*, 220*e*, respectively, that extend substantially perpendicular to either outer planar surfaces 214*e*, 216*e*, respectively.

However, in this embodiment the respective grooves, 210*e*, 212*e* have been configured such that a space or gap 226 has been created between the respective grooves 210*e*, 212*e*.

Figure 26:
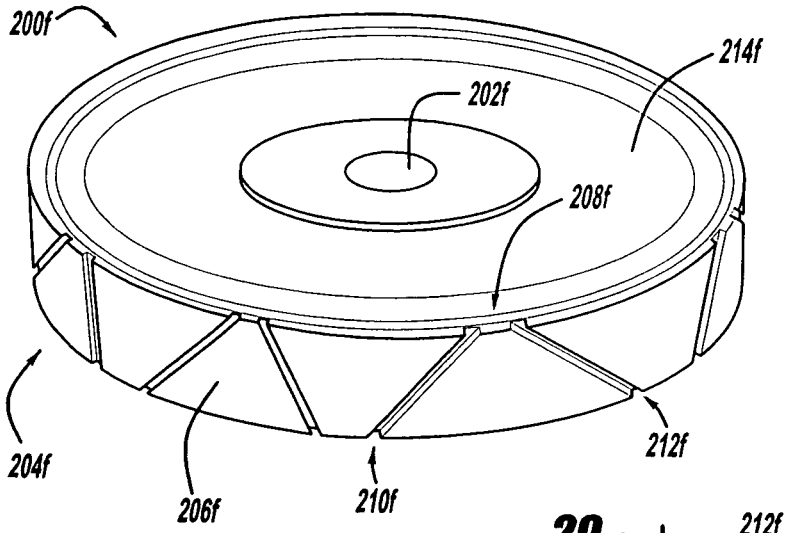
FIG. 26 is a perspective view of a second alternative polishing wheel, in accordance with a sixth embodiment of the present invention.
Figure 27:
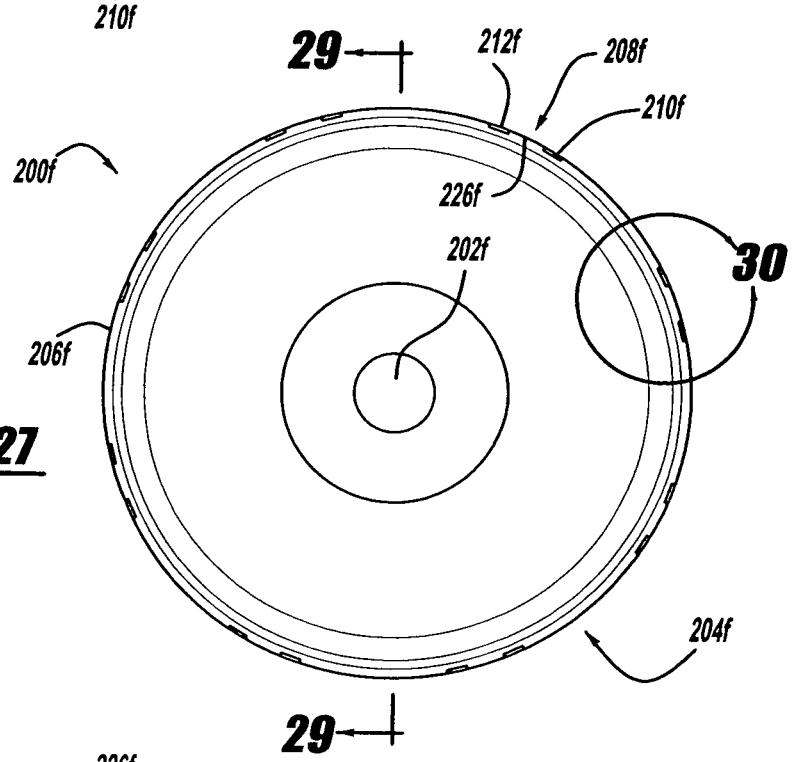
FIG. 27 is an elevational view of the second alternative polishing wheel depicted in FIG. 26, in accordance with the sixth embodiment of the present invention.
Figure 28:
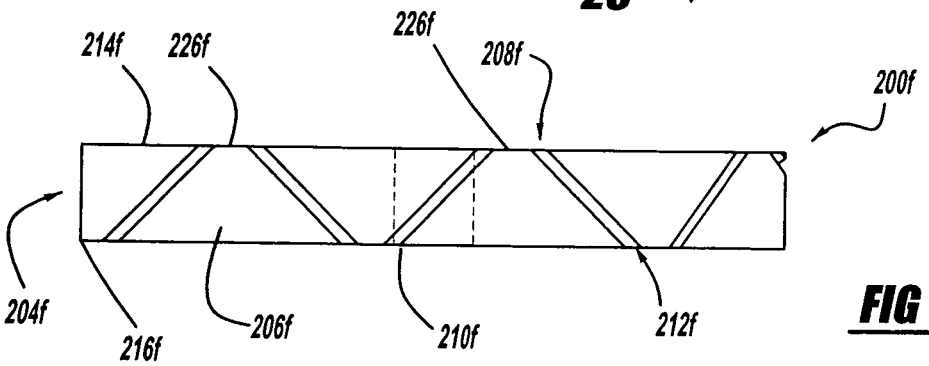
FIG. 28 is a top view of the second alternative polishing wheel depicted in FIGS. 26 and 27, in accordance with the sixth embodiment of the present invention.
Figure 29:
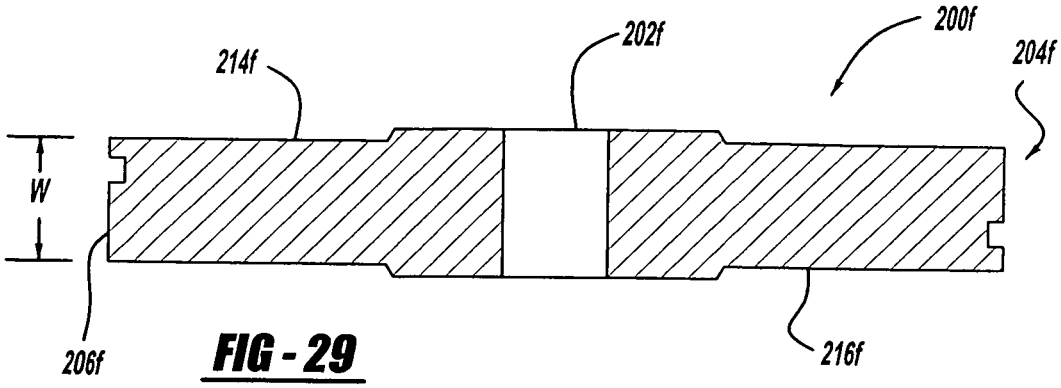
FIG. 29 is a sectional plan view taken along line 29-29 of FIG. 27 of the second alternative polishing wheel depicted in FIGS. 26-28, in accordance with the sixth embodiment of the present invention.
Figure 30:
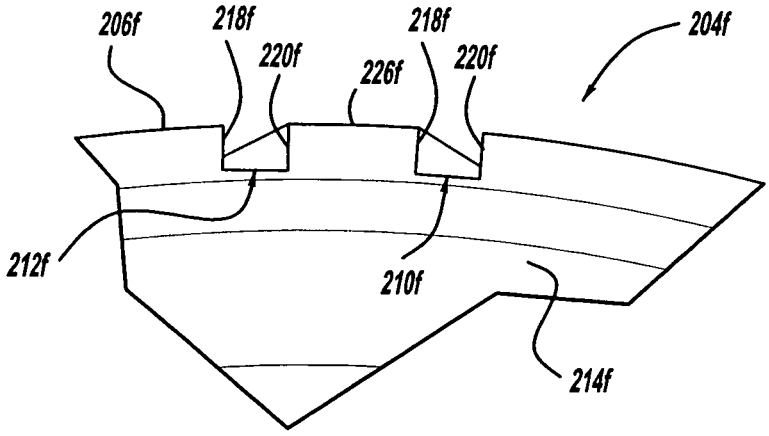
FIG. 30 is a detailed side view illustrating the swarf-clearing groove of the second alternative polishing wheel depicted in FIGS. 26-29, in accordance with the sixth embodiment of the present invention.

In accordance with a sixth embodiment of the present invention, there is provided a second alternative polishing wheel generally shown at 200*f* for polishing of an optical lens, as shown in FIGS. 26-30. Again, the intended purpose of the polishing wheel 200*f* is to, among other things, facilitate the removal of swarf material.

The polishing wheel 200*f* is similar to the rough cutting wheel 200*e* shown in FIGS. 21-25, e.g., it includes a hub portion 202*f*, an outer circumferential cutting surface 204*f* (having a width W), an abrasive grit material 206*f*, at least one pair 208*f* of substantially adjacent swarf-clearing grooves 210*f*, 212*f*, respectively, that extend across the width W of the cutting surface 204*f*, i.e., are contiguous from a first outer planar surface 214*f* to a second spaced and opposed outer planar surface 216*f* of the wheel 200*f*, wherein each of the grooves 210*f*, 212*f*, respectively, preferably has planar sides 218*f*, 220*f*, respectively, that extend substantially perpendicular to either outer planar surfaces 214*f*, 216*f*, respectively, and a gap 226*f* formed between the respective grooves 210*f*, 212*f*.

However, as with the embodiment shown in FIGS. 6-10 and 16-20, because the polishing wheel 200*f* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*f* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

Figure 31:
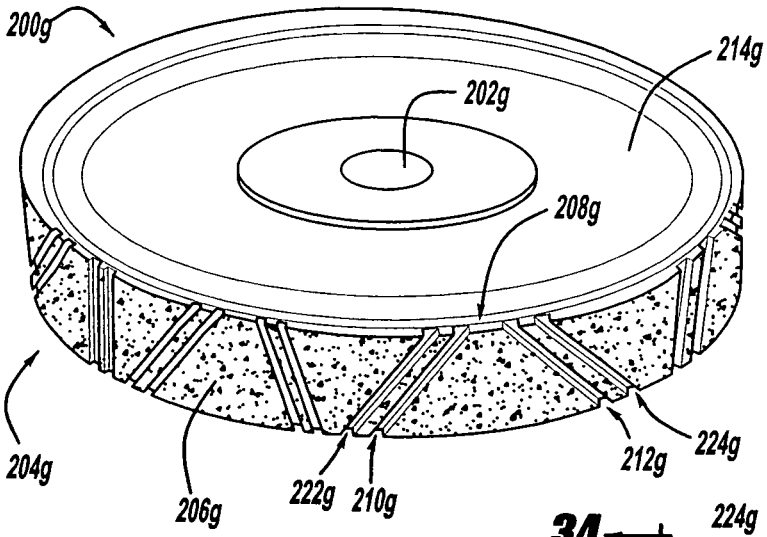
FIG. 31 is a perspective view of a third alternative roughing wheel, in accordance with a seventh embodiment of the present invention.
Figure 32:
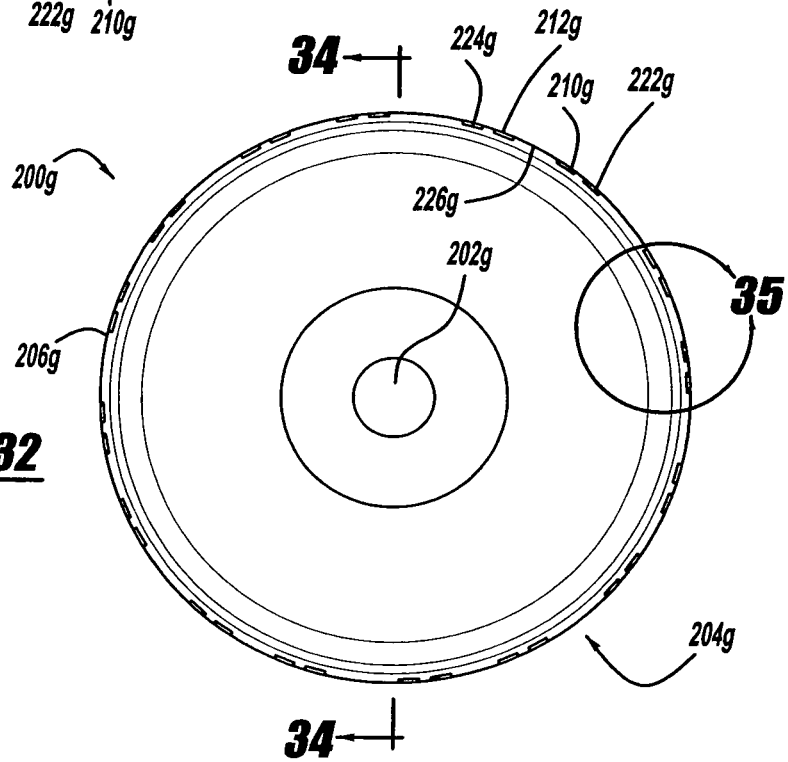
FIG. 32 is an elevational view of the third alternative roughing wheel depicted in FIG. 31, in accordance with the seventh embodiment of the present invention.
Figure 33:
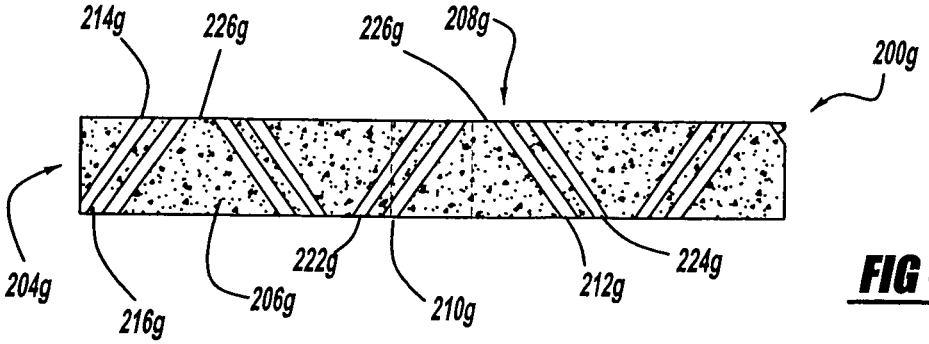
FIG. 33 is a top view of the third alternative roughing wheel depicted in FIGS. 31 and 32, in accordance with the seventh embodiment of the present invention.
Figure 34:
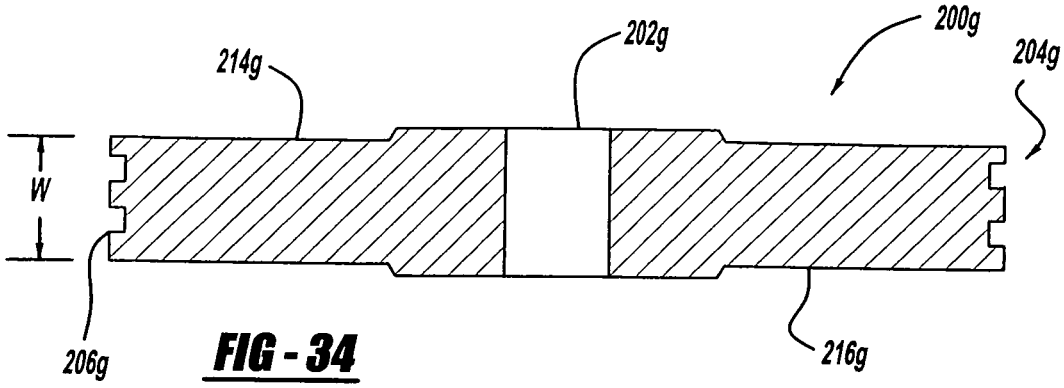
FIG. 34 is a sectional plan view taken along line 34-34 of FIG. 32 of the third alternative roughing wheel depicted in FIGS. 31-33, in accordance with the seventh embodiment of the present invention.
Figure 35:
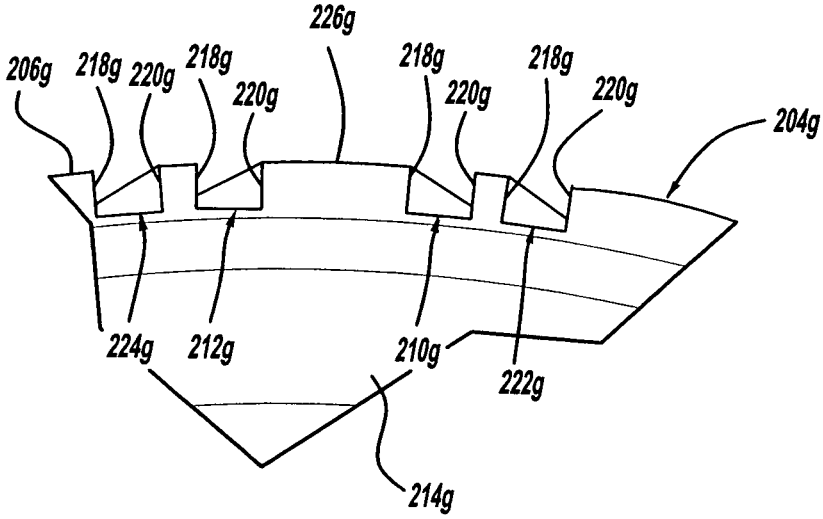
FIG. 35 is a detailed side view illustrating the swarf-clearing groove of the third alternative roughing wheel depicted in FIGS. 31-34, in accordance with the seventh embodiment of the present invention.

In accordance with a seventh embodiment of the present invention, there is provided a third alternative rough cutting wheel generally shown at 200*g* for rough cutting of an optical lens, as shown in FIGS. 31-35. Again, the intended purpose of the rough cutting wheel 200*g* is to, among other things, facilitate the removal of swarf material.

The rough cutting wheel 200*g* is similar to the rough cutting wheel 200*e* shown in FIGS. 21-25, e.g., it includes a hub portion 202*g*, an outer circumferential cutting surface 204*g* (having a width W), an abrasive grit material 206*g*, at least one pair 208*g* of substantially adjacent swarf-clearing grooves 210*g*, 212*g*, respectively, that extend across the width W of the cutting surface 204*g*, i.e., are contiguous from a first outer planar surface 214*g* to a second spaced and opposed outer planar surface 216*g* of the wheel 200*g*, wherein each of the grooves 210*g*, 212*g*, respectively, preferably has planar sides 218*g*, 220*g*, respectively, that extend substantially perpendicular to either outer planar surfaces 214*g*, 216*g*, respectively, and a gap 226*g* formed between the respective grooves 210*g*, 212*g*.

However, this embodiment differs in that two additional swarf-clearing grooves 222*g* and 224*g* respectively are provided in proximity to grooves 210*g*, 212*g*, respectively.

Figure 36:
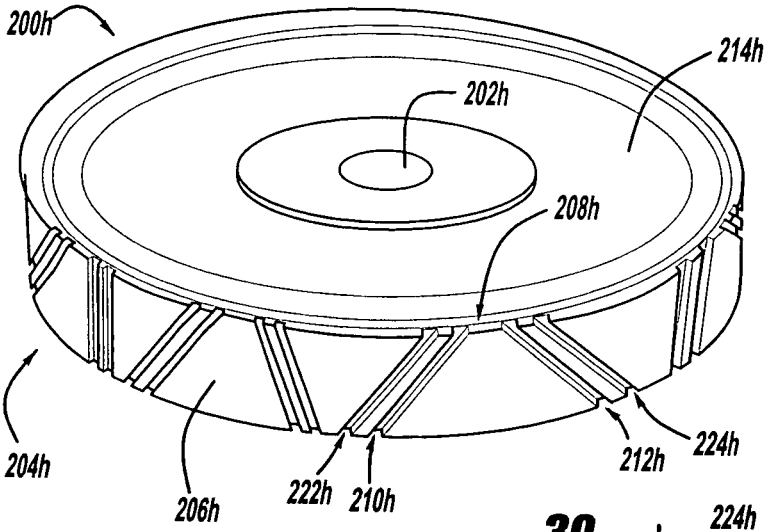
FIG. 36 is a perspective view of a third alternative polishing wheel, in accordance with an eighth embodiment of the present invention.
Figure 37:
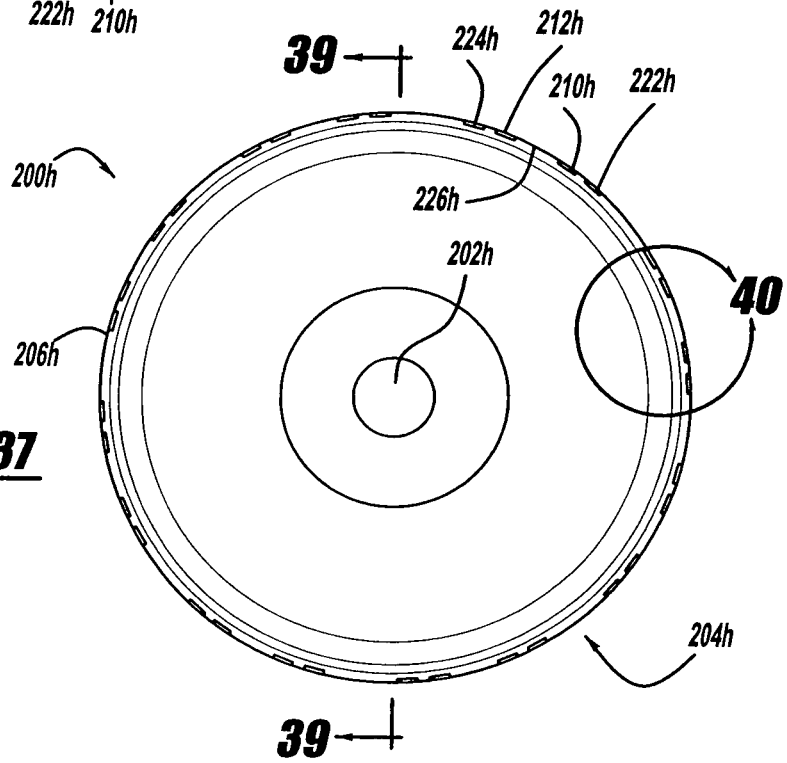
FIG. 37 is an elevational view of the third alternative polishing wheel depicted in FIG. 36, in accordance with the eighth embodiment of the present invention.
Figure 38:
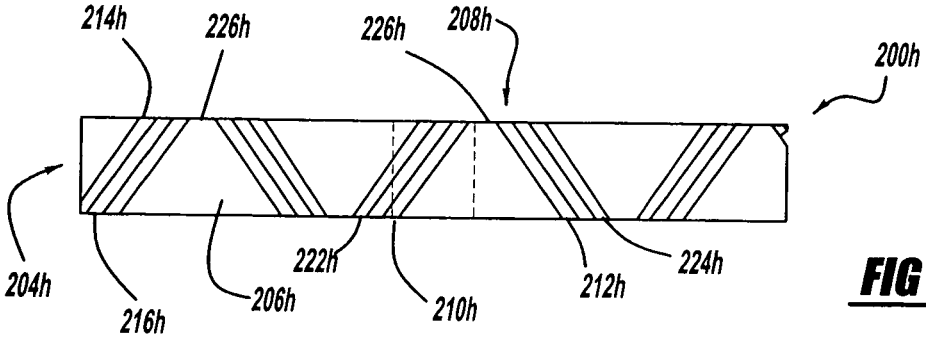
FIG. 38 is a top view of the third alternative polishing wheel depicted in FIGS. 36 and 37, in accordance with the eighth embodiment of the present invention.
Figure 39:
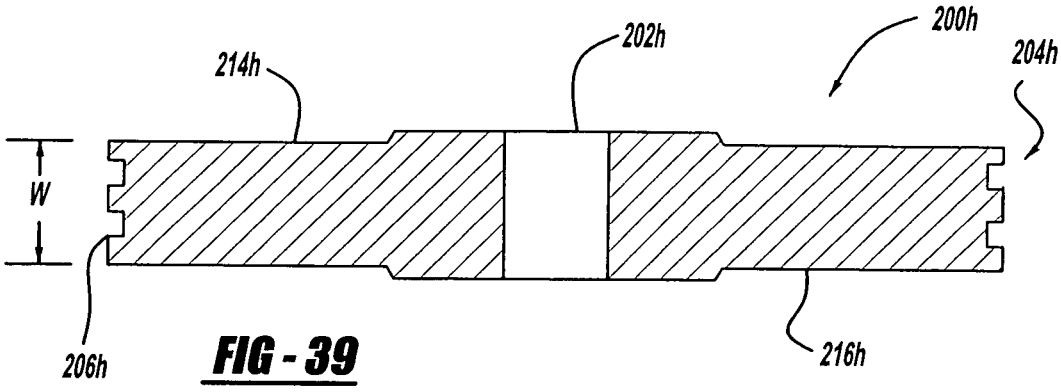
FIG. 39 is a sectional plan view taken along line 39-39 of FIG. 37 of the third alternative polishing wheel depicted in FIGS. 36-38, in accordance with the eighth embodiment of the present invention.
Figure 40:
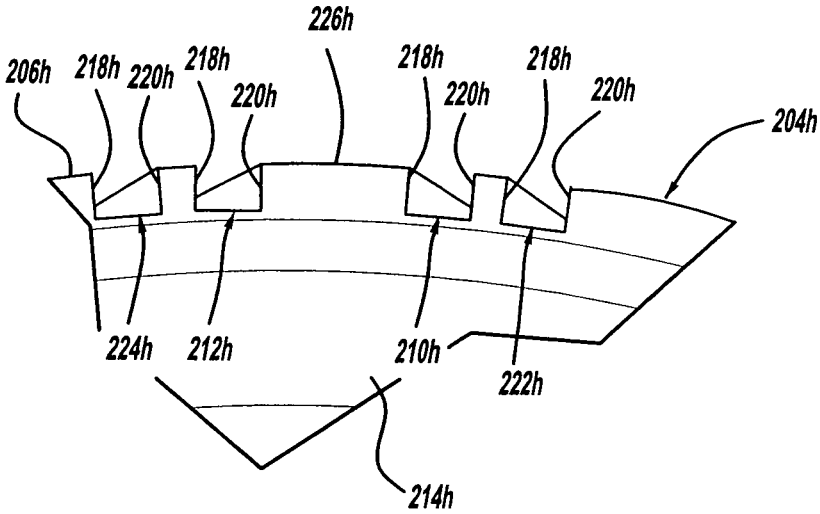
FIG. 40 is a detailed side view illustrating the swarf-clearing groove of the third alternative polishing wheel depicted in FIGS. 36-39, in accordance with the eighth embodiment of the present invention.

In accordance with an eighth embodiment of the present invention, there is provided a third alternative polishing wheel generally shown at 200*h* for polishing of an optical lens, as shown in FIGS. 36-40. Again, the intended purpose of the polishing wheel 200*h* is to, among other things, facilitate the removal of swarf material.

The polishing wheel 200*h* is similar to the rough cutting wheel 200*g* shown in FIGS. 31-35, e.g., it includes a hub portion 202*h*, an outer circumferential cutting surface 204*h* (having a width W), an abrasive grit material 206*h*, at least one pair 208*h* of substantially adjacent swarf-clearing grooves 210*h*, 212*h*, 222*h*, 224*h*, respectively, that extend across the width W of the cutting surface 204*h*, i.e., are contiguous from a first outer planar surface 214*h* to a second spaced and opposed outer planar surface 216*h* of the wheel 200*h*, wherein each of the grooves 210*h*, 212*h*, 222*h*, 224*h*, respectively, preferably has planar sides 218*h*, 220*h*, respectively, that extend substantially perpendicular to either outer planar surfaces 214*h*, 216*h*, respectively.

However, as with the embodiment shown in FIGS. 6-10, because the polishing wheel 200*h* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*h* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

Figure 41:
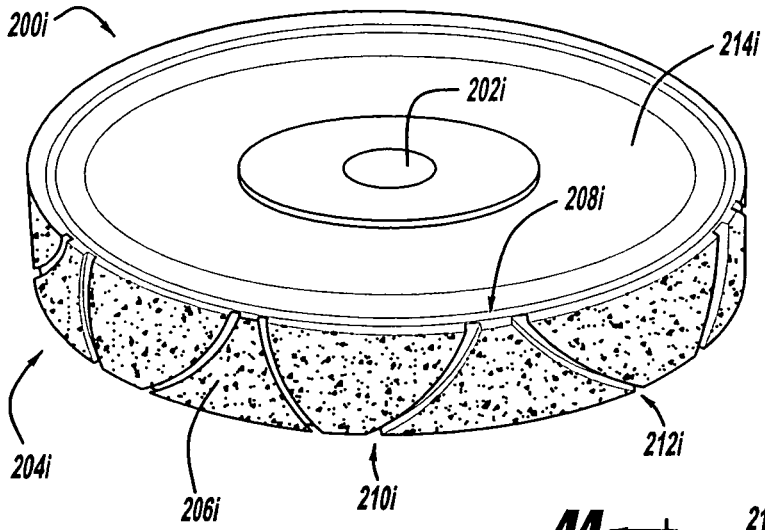
FIG. 41 is a perspective view of a fourth alternative roughing wheel, in accordance with a ninth embodiment of the present invention.
Figure 42:
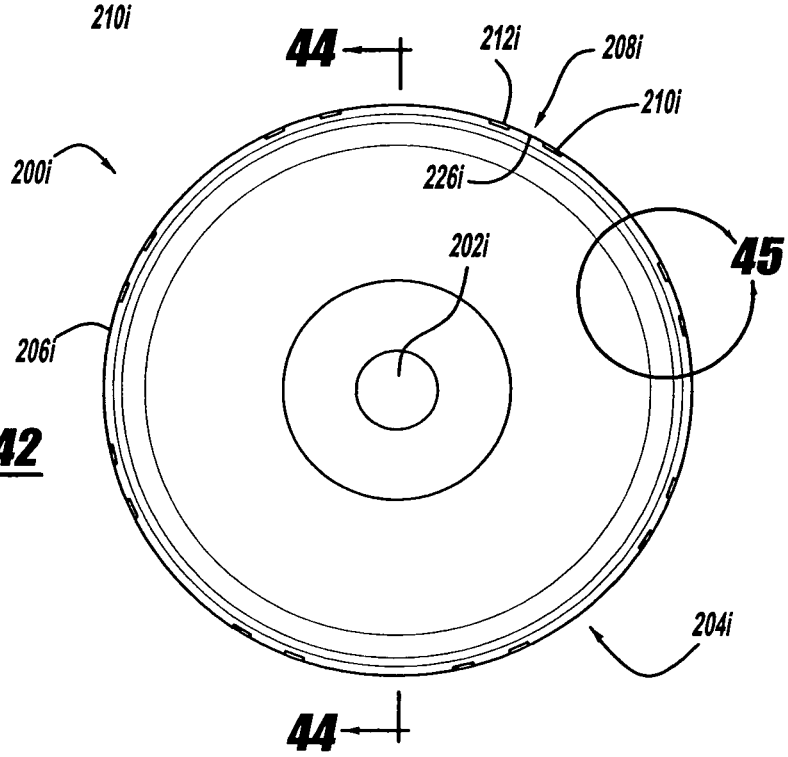
FIG. 42 is an elevational view of the fourth alternative roughing wheel depicted in FIG. 41, in accordance with the ninth embodiment of the present invention.
Figure 43:
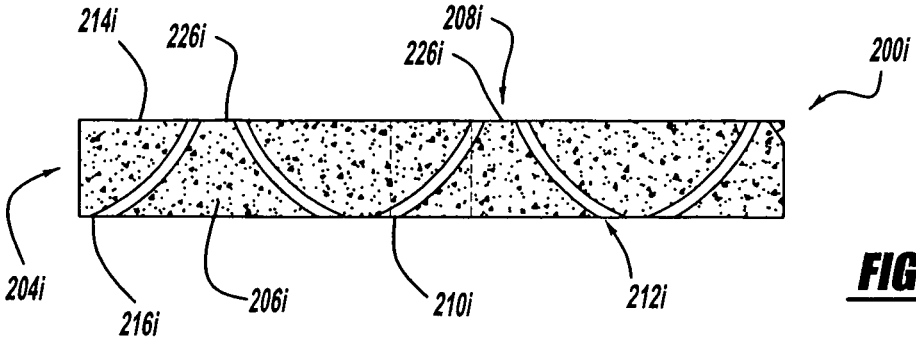
FIG. 43 is a top view of the fourth alternative roughing wheel depicted in FIGS. 41 and 42, in accordance with the ninth embodiment of the present invention.
Figure 44:
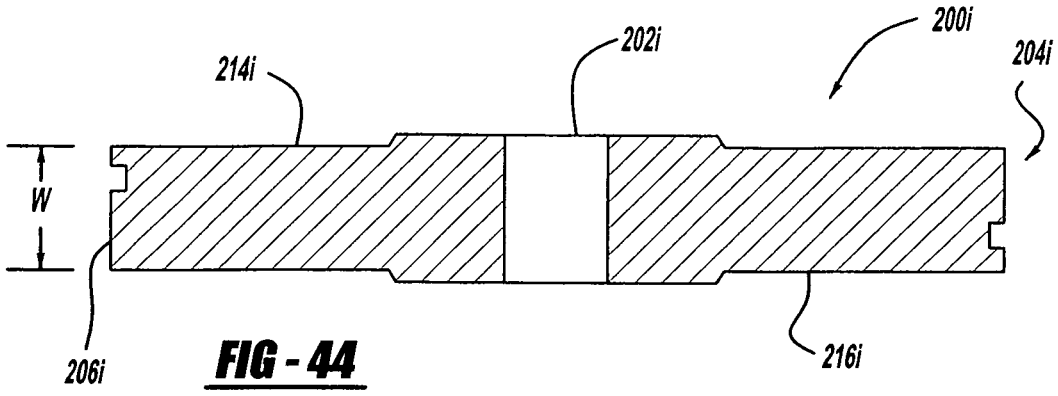
FIG. 44 is a sectional plan view taken along line 44-44 of FIG. 42 of the fourth alternative roughing wheel depicted in FIGS. 41-43, in accordance with the ninth embodiment of the present invention.
Figure 45:
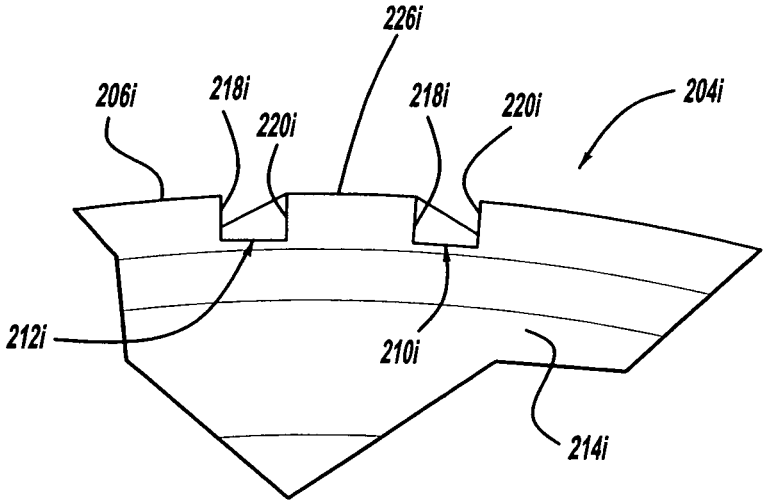
FIG. 45 is a detailed side view illustrating the swarf-clearing groove of the fourth alternative roughing wheel depicted in FIGS. 41-44, in accordance with the ninth embodiment of the present invention.

In accordance with a ninth embodiment of the present invention, there is provided a fourth alternative rough cutting wheel generally shown at 200*i* for rough cutting of an optical lens, as shown in FIGS. 41-45. Again, the intended purpose of the rough cutting wheel 200*i* is to, among other things, facilitate the removal of swarf material.

The rough cutting wheel 200*i* is similar to the rough cutting wheel 200*e* shown in FIGS. 21-25, e.g., it includes a hub portion 202*i*, an outer circumferential cutting surface 204*i* (having a width W), an abrasive grit material 206*i*, at least one pair 208*i* of substantially adjacent swarf-clearing grooves 210*i*, 212*i*, respectively, that extend across the width W of the cutting surface 204*i*, i.e., are contiguous from a first outer planar surface 214*i* to a second spaced and opposed outer planar surface 216*i* of the wheel 200*i*, wherein each of the grooves 210*i*, 212*i*, respectively, preferably has planar sides 218*i*, 220*i*, respectively, that extend substantially perpendicular to either outer planar surfaces 214*i*, 216*i*, respectively, and an optional gap 226*i* formed between the respective grooves 210*i*, 212*i*.

However, this embodiment differs in that the grooves 210*i* and 212*i*, respectively, are curved with respect to either outer planar surfaces 214*i*, 216*i*, respectively. The exact degree and/or direction of curvature is not thought to be critical to the success of the present invention, provided it does not hamper the swarf removal process.

Figure 46:
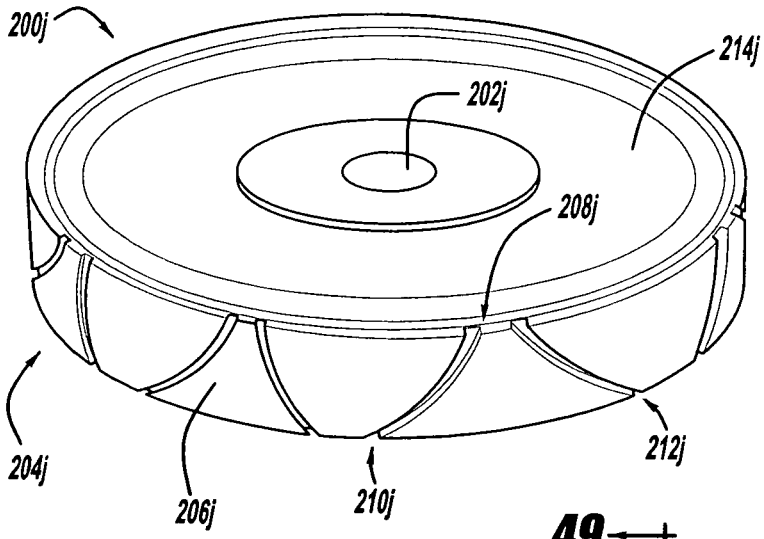
FIG. 46 is a perspective view of a fourth alternative polishing wheel, in accordance with a tenth embodiment of the present invention.
Figure 47:
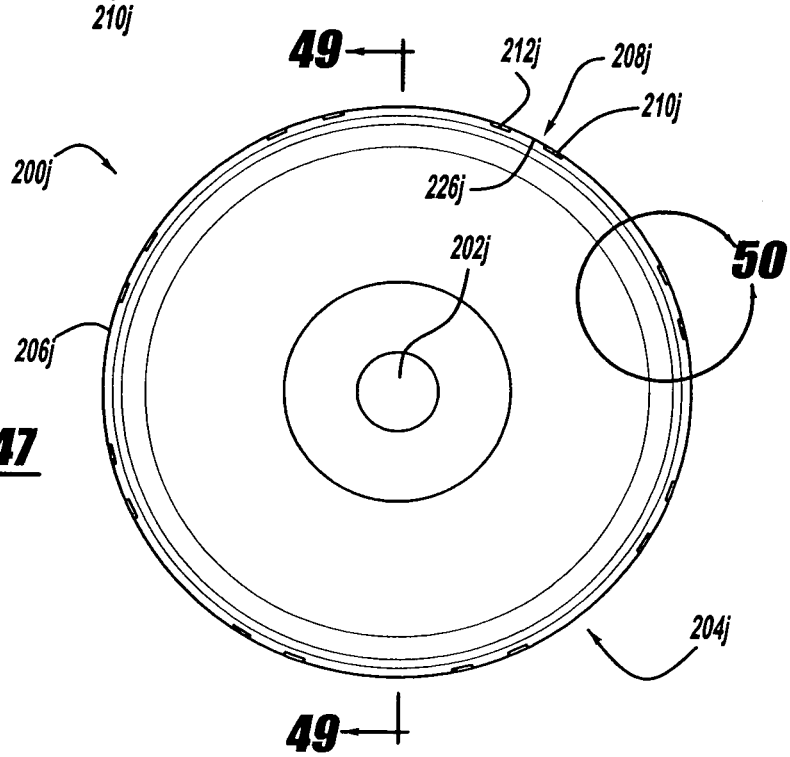
FIG. 47 is an elevational view of the fourth alternative polishing wheel depicted in FIG. 46, in accordance with the tenth embodiment of the present invention.
Figure 48:
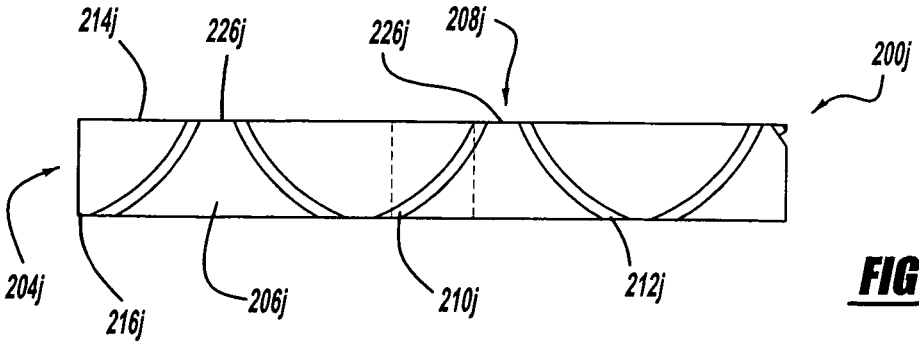
FIG. 48 is a top view of the fourth alternative polishing wheel depicted in FIGS. 46 and 47, in accordance with the tenth embodiment of the present invention.
Figure 49:
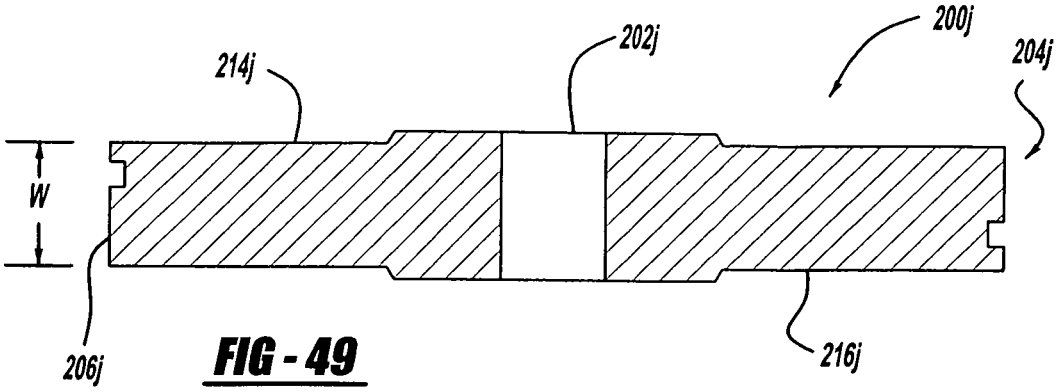
FIG. 49 is a sectional plan view taken along line 49-49 of FIG. 47 of the fourth alternative polishing wheel depicted in FIGS. 46-48, in accordance with the tenth embodiment of the present invention.
Figure 50:
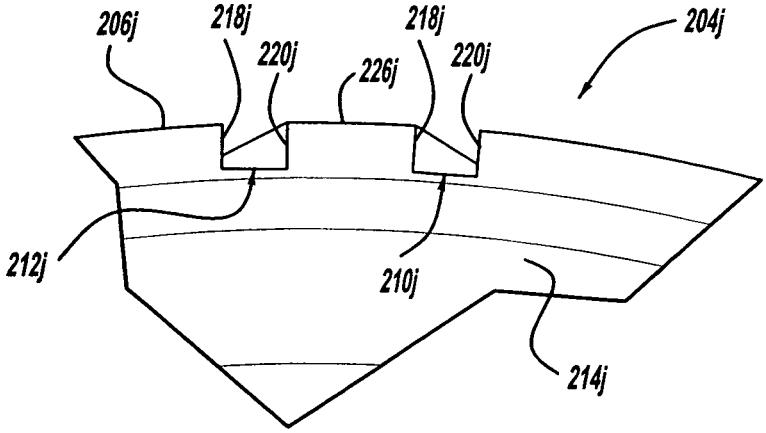
FIG. 50 is a detailed side view illustrating the swarf-clearing groove of the fourth alternative polishing wheel depicted in FIGS. 46-49, in accordance with the tenth embodiment of the present invention.

In accordance with a tenth embodiment of the present invention, there is provided a fourth alternative polishing wheel generally shown at 200*j* for polishing of an optical lens, as shown in FIGS. 46-50. Again, the intended purpose of the polishing wheel 200*j* is to, among other things, facilitate the removal of swarf material.

The polishing wheel 200*j* is similar to the rough cutting wheel 200*i* shown in FIGS. 41-45, e.g., it includes a hub portion 202*j*, an outer circumferential cutting surface 204*j* (having a width W), an abrasive grit material 206*j*, at least one pair 208*j* of substantially adjacent curved swarf-clearing grooves 210*j*, 212*j*, respectively, that extend across the width W of the cutting surface 204*j*, i.e., are contiguous from a first outer planar surface 214*j* to a second spaced and opposed outer planar surface 216*j* of the wheel 200*j*, wherein each of the curved grooves 210*j*, 212*j*, respectively, preferably has planar sides 218*j*, 220*j*, respectively, that extend substantially perpendicular to either outer planar surfaces 214*j*, 216*j*, respectively, and an optional gap 226*j* formed between the respective grooves 210*j*, 212*j*.

However, as with the embodiment shown in FIGS. 6-10, because the polishing wheel 200*j* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*j* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

Figure 51:
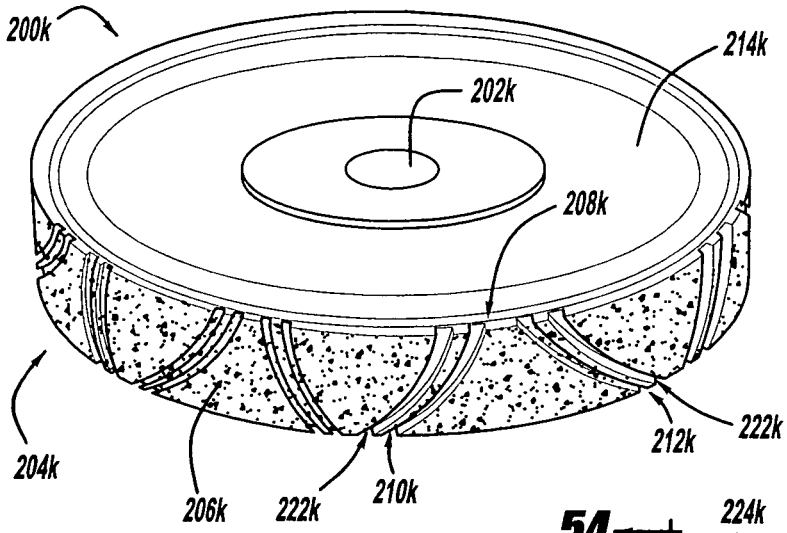
FIG. 51 is a perspective view of a fifth alternative roughing wheel, in accordance with an eleventh embodiment of the present invention.
Figure 52:
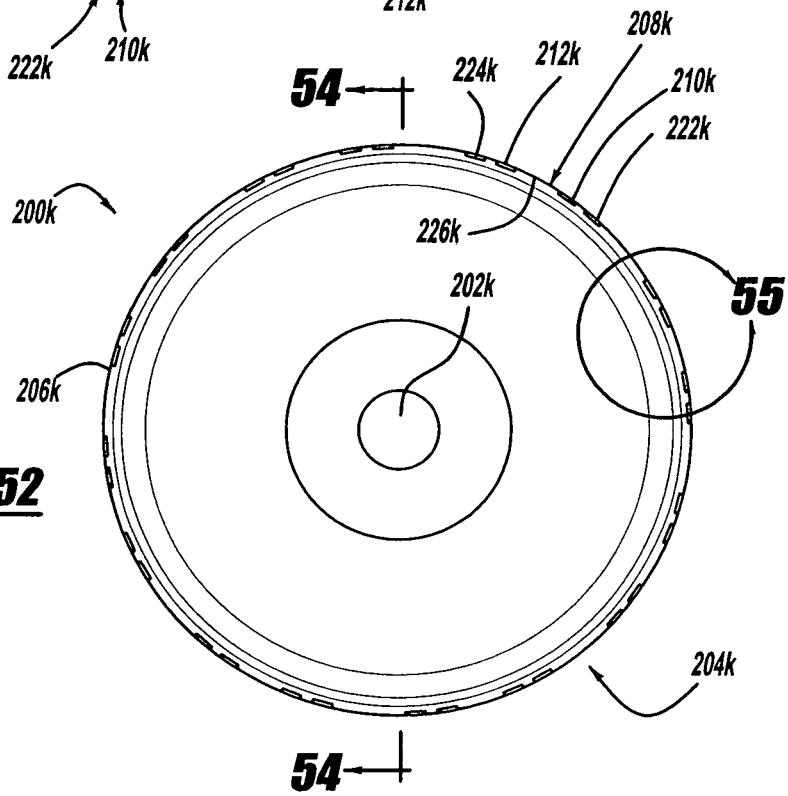
FIG. 52 is an elevational view of the fifth alternative roughing wheel depicted in FIG. 51, in accordance with the eleventh embodiment of the present invention.
Figure 53:
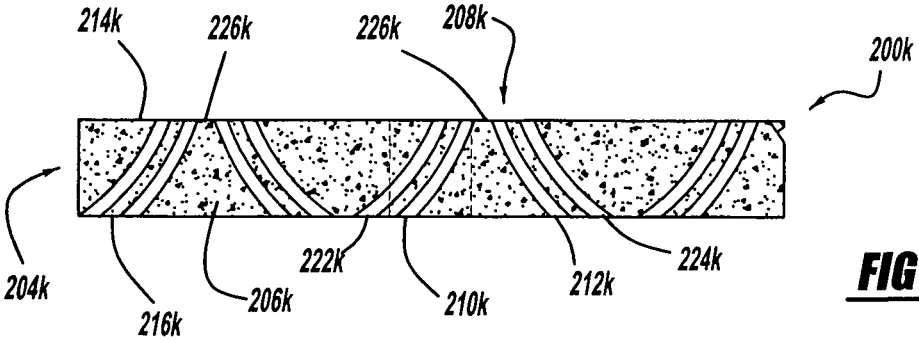
FIG. 53 is a top view of the fifth alternative roughing wheel depicted in FIGS. 51 and 52, in accordance with the eleventh embodiment of the present invention.
Figure 54:
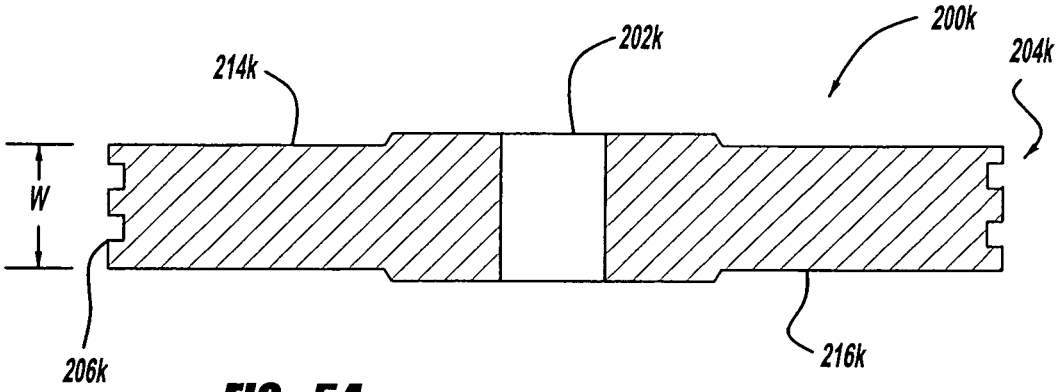
FIG. 54 is a sectional plan view taken along line 54-54 of FIG. 52 of the fifth alternative roughing wheel depicted in FIGS. 51-53, in accordance with the eleventh embodiment of the present invention.
Figure 55:
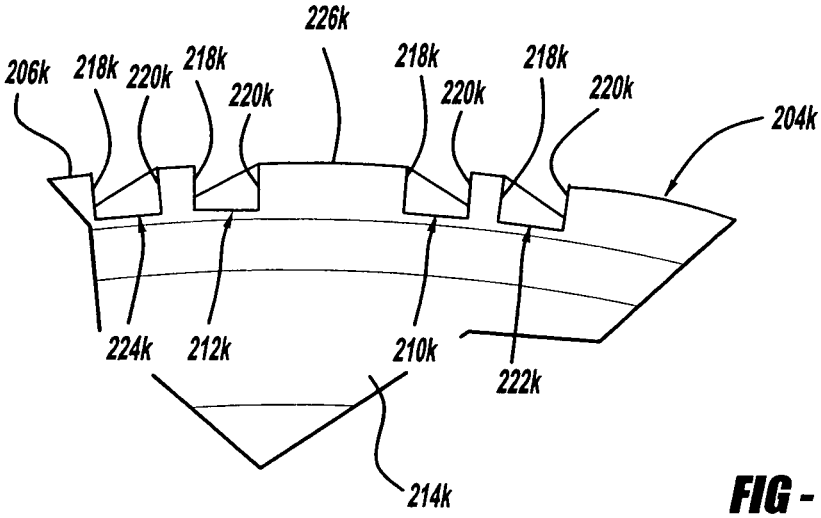
FIG. 55 is a detailed side view illustrating the swarf-clearing groove of the fifth alternative roughing wheel depicted in FIGS. 51-54, in accordance with the eleventh embodiment of the present invention.

In accordance with an eleventh embodiment of the present invention, there is provided a fifth alternative rough cutting wheel generally shown at 200*k* for rough cutting of an optical lens, as shown in FIGS. 51-55. Again, the intended purpose of the rough cutting wheel 200*k* is to, among other things, facilitate the removal of swarf material.

The rough cutting wheel 200*k* is similar to the rough cutting wheel 200*i* shown in FIGS. 41-45, e.g., it includes a hub portion 202*k*, an outer circumferential cutting surface 204*k* (having a width W), an abrasive grit material 206*k*, at least one pair 208*k* of substantially adjacent curved swarf-clearing grooves 210*k*, 212*k*, respectively, that extend across the width W of the cutting surface 204*k*, i.e., are contiguous from a first outer planar surface 214*k* to a second spaced and opposed outer planar surface 216*k* of the wheel 200*k*, wherein each of the grooves 210*k*, 212*k*, respectively, preferably has planar sides 218*k*, 220*k*, respectively, that extend substantially perpendicular to either outer planar surfaces 214*k*, 216*k*, respectively, and an optional gap 226*k* formed between the respective grooves 210*k*, 212*k*.

However, this embodiment differs in that two additional curved swarf-clearing grooves 222*k* and 224*k* respectively are provided in proximity to curved grooves 210*k*, 212*k*, respectively.

Figure 56:
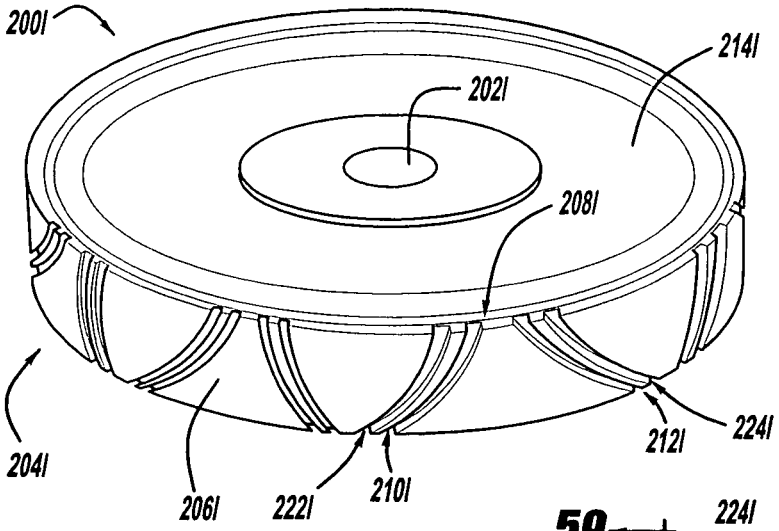
FIG. 56 is a perspective view of a fifth alternative polishing wheel, in accordance with a twelfth embodiment of the present invention.
Figure 57:
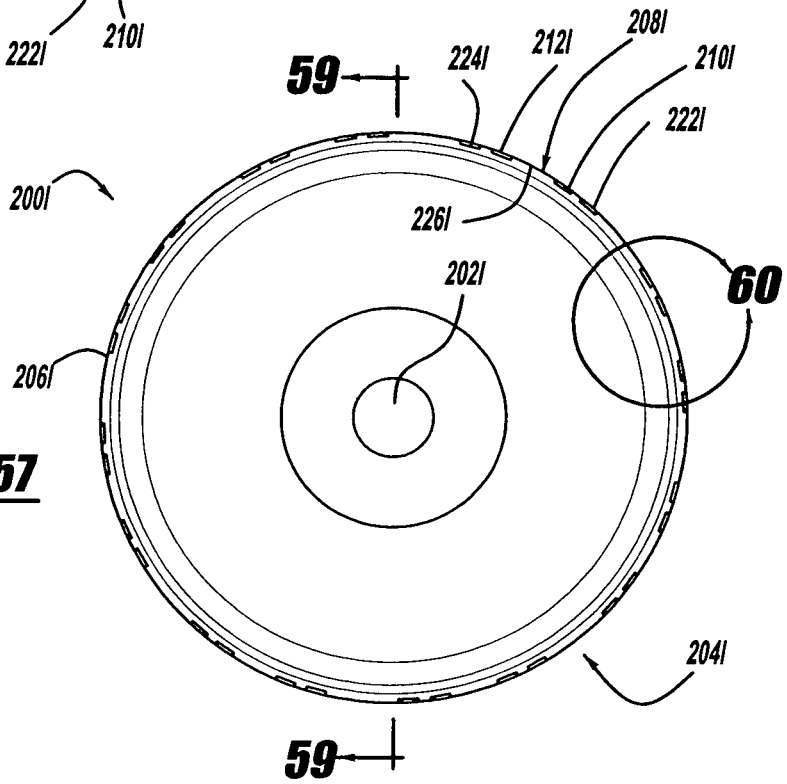
FIG. 57 is an elevational view of the fifth alternative polishing wheel depicted in FIG. 56, in accordance with the twelfth embodiment of the present invention.
Figure 58:
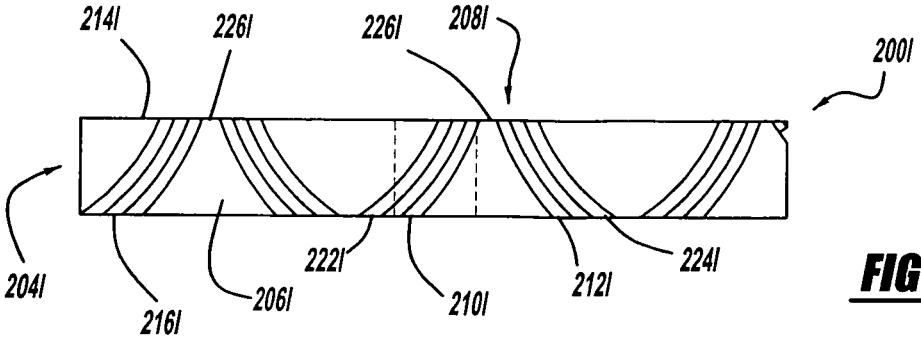
FIG. 58 is a top view of the fifth alternative polishing wheel depicted in FIGS. 56 and 57, in accordance with the twelfth embodiment of the present invention.
Figure 59:
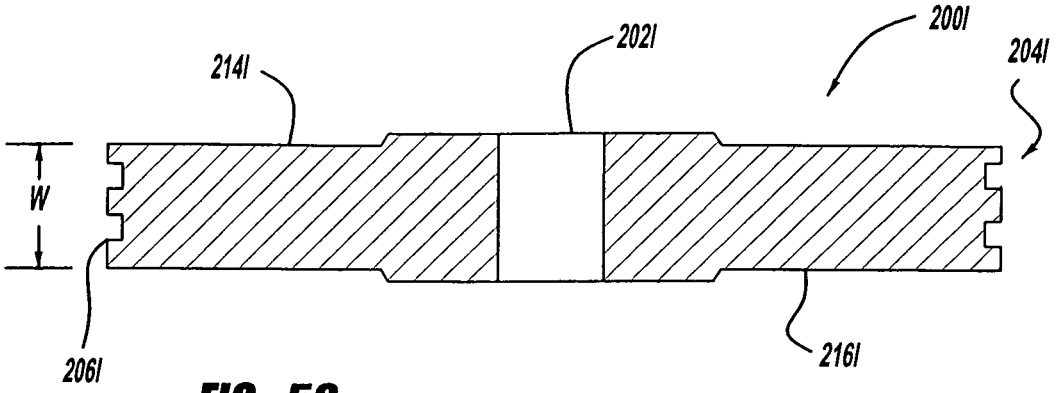
FIG. 59 is a sectional plan view taken along line 59-59 of FIG. 57 of the fifth alternative polishing wheel depicted in FIGS. 56-58, in accordance with the twelfth embodiment of the present invention.
Figure 60:
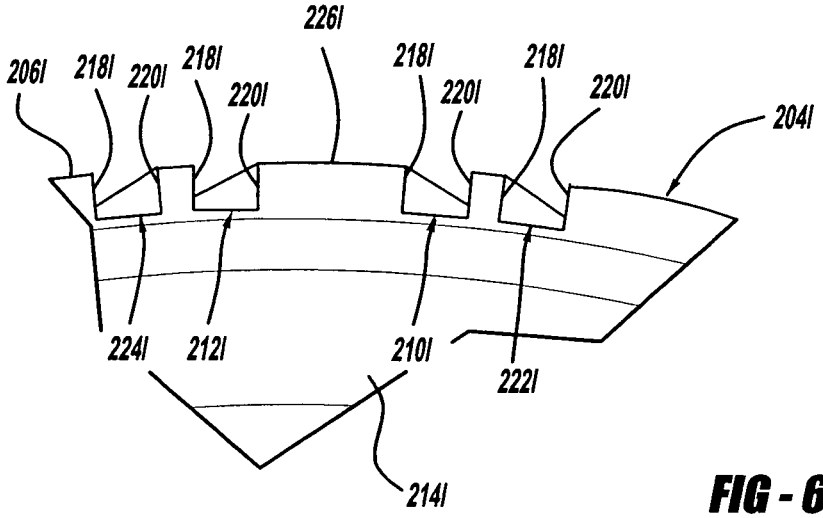
FIG. 60 is a detailed side view illustrating the swarf-clearing groove of the fifth alternative polishing wheel depicted in FIGS. 56-59, in accordance with the twelfth embodiment of the present invention.

In accordance with a twelfth embodiment of the present invention, there is provided a fifth alternative polishing wheel generally shown at 200*l* for polishing of an optical lens, as shown in FIGS. 56-60. Again, the intended purpose of the polishing wheel 200*l* is to, among other things, facilitate the removal of swarf material.

The polishing wheel 200*l* is similar to the rough cutting wheel 200*k* shown in FIGS. 51-55, e.g., it includes a hub portion 202*l*, an outer circumferential cutting surface 204*l* (having a width W), an abrasive grit material 206*l*, at least one pair 208*l* of substantially adjacent curved swarf-clearing grooves 210*l*, 212*l*, 222*l*, 224*l*, respectively, that extend across the width W of the cutting surface 204*l*, i.e., are contiguous from a first outer planar surface 214*l* to a second spaced and opposed outer planar surface 216*l* of the wheel 200*l*, wherein each of the curved grooves 210*l*, 212*l*, 222*l*, 224*l*, respectively, preferably has planar sides 218*l*, 220*l*, respectively, that extend substantially perpendicular to either outer planar surfaces 214*l*, 216*l*, respectively, and an optional gap 226*l* formed between the respective grooves 210*l*, 212*l*.

However, as with the embodiment shown in FIGS. 6-10, because the polishing wheel 200*l* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*l* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

Figure 61:
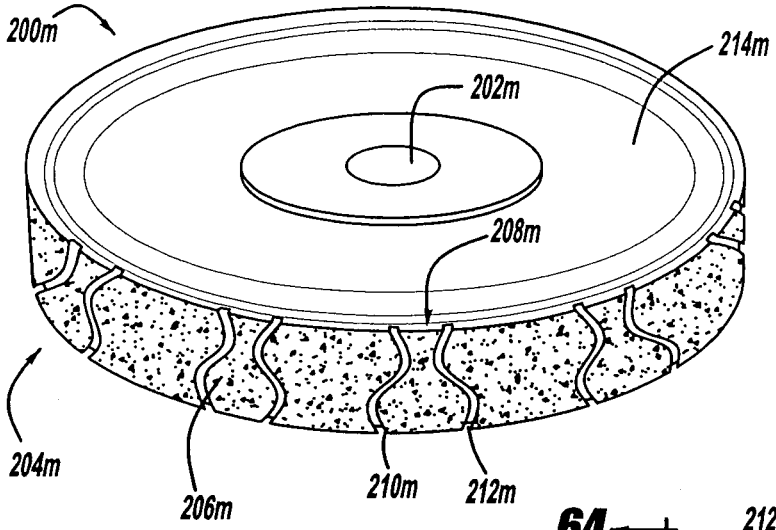
FIG. 61 is a perspective view of a sixth alternative roughing wheel, in accordance with a thirteenth embodiment of the present invention.
Figure 62:
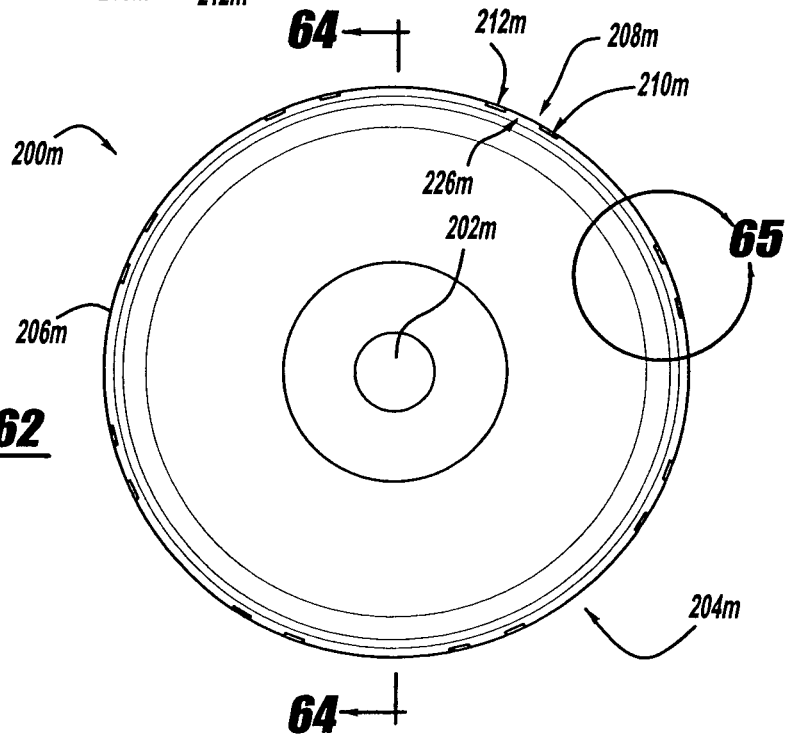
FIG. 62 is an elevational view of the sixth alternative roughing wheel depicted in FIG. 61, in accordance with the thirteenth embodiment of the present invention.
Figure 63:
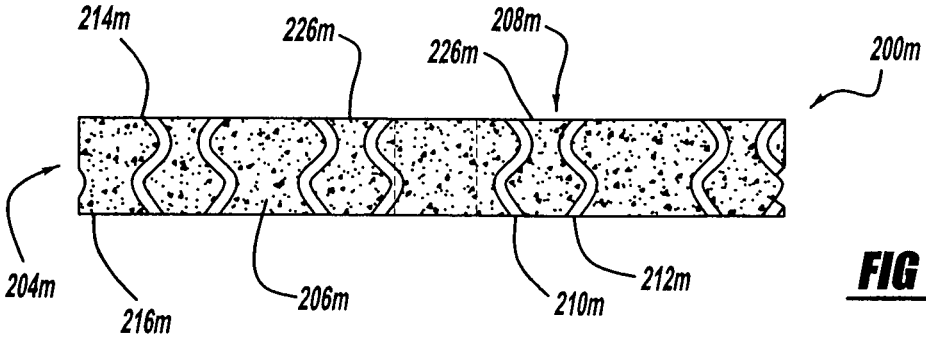
FIG. 63 is a top view of the sixth alternative roughing wheel depicted in FIGS. 61 and 62, in accordance with the thirteenth embodiment of the present invention.
Figure 64:
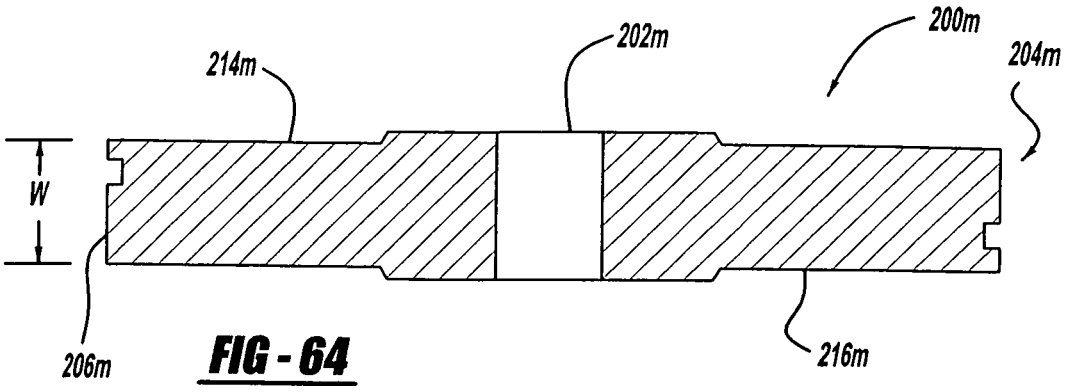
FIG. 64 is a sectional plan view taken along line 64-64 of FIG. 62 of the sixth alternative roughing wheel depicted in FIGS. 61-63, in accordance with the thirteenth embodiment of the present invention.
Figure 65:
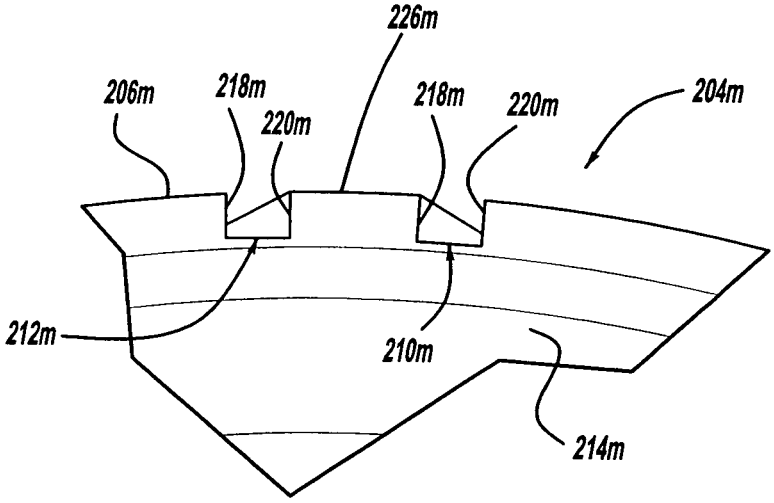
FIG. 65 is a detailed side view illustrating the swarf-clearing groove of the sixth alternative roughing wheel depicted in FIGS. 61-64, in accordance with the thirteenth embodiment of the present invention.

In accordance with a thirteenth embodiment of the present invention, there is provided a sixth alternative rough cutting wheel generally shown at 200*m* for rough cutting of an optical lens, as shown in FIGS. 61-65. Again, the intended purpose of the rough cutting wheel 200*m* is to, among other things, facilitate the removal of swarf material.

The rough cutting wheel 200*m* is similar to the rough cutting wheel 200*i* shown in FIGS. 41-45, e.g., it includes a hub portion 202*m*, an outer circumferential cutting surface 204*m* (having a width W), an abrasive grit material 206*m*, at least one pair 208*m* of substantially adjacent curved swarf-clearing grooves 210*m*, 212*m*, respectively, that extend across the width W of the cutting surface 204*m*, i.e., are contiguous from a first outer planar surface 214*m* to a second spaced and opposed outer planar surface 216*m* of the wheel 200*m*, wherein each of the grooves 210*m*, 212*m*, respectively, preferably has planar sides 218*m*, 220*m*, respectively, that extend substantially perpendicular to either outer planar surfaces 214*m*, 216*m*, respectively, and an optional gap 226*m* formed between the respective grooves 210*m*, 212*m*.

However, this embodiment differs in that the curved grooves 210*m* and 212*m*, respectively, are substantially serpentine in configuration, as opposed to being gradually curved.

Figure 66:
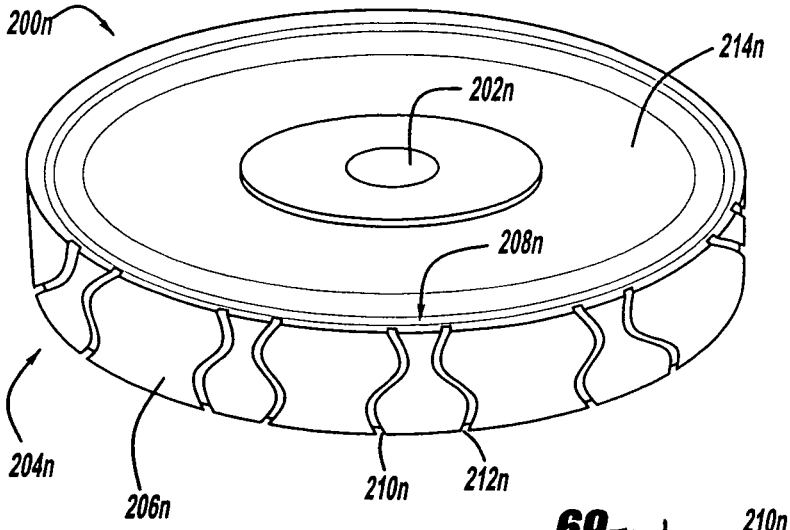
FIG. 66 is a perspective view of a sixth alternative polishing wheel, in accordance with a fourteenth embodiment of the present invention.
Figure 67:
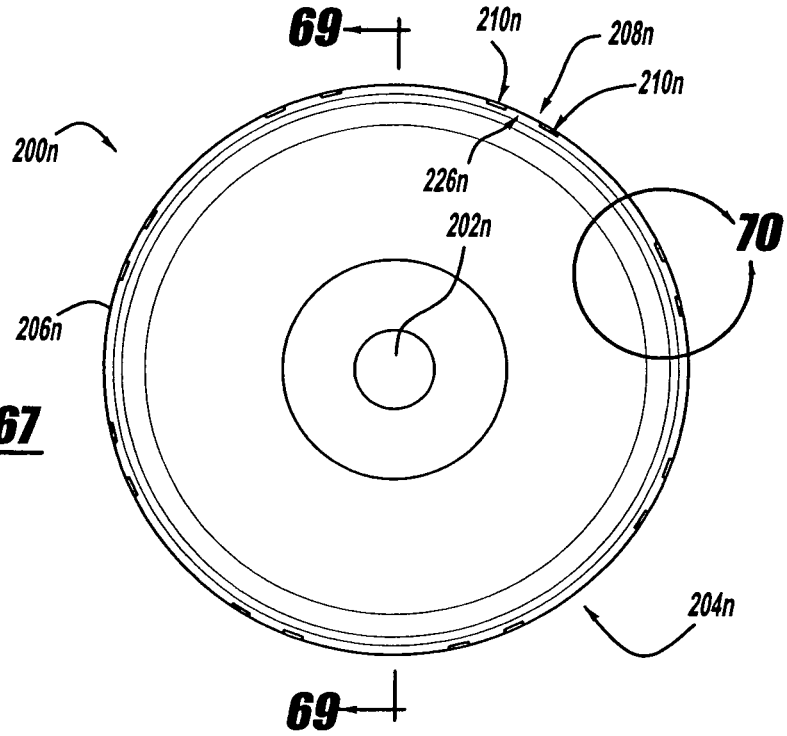
FIG. 67 is an elevational view of the sixth alternative polishing wheel depicted in FIG. 66, in accordance with the fourteenth embodiment of the present invention.
Figure 68:
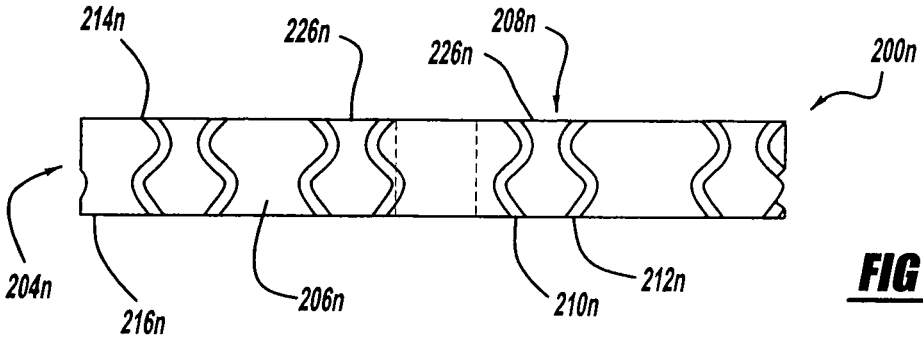
FIG. 68 is a top view of the sixth alternative polishing wheel depicted in FIGS. 66 and 67, in accordance with the fourteenth embodiment of the present invention.
Figure 69:
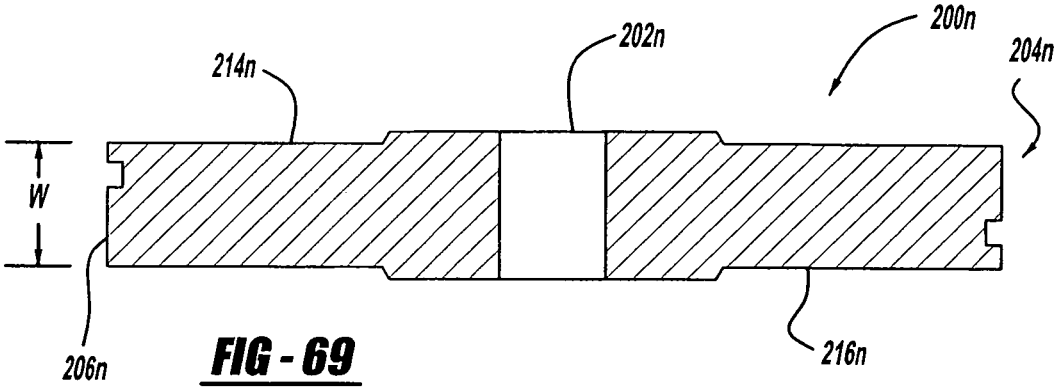
FIG. 69 is a sectional plan view taken along line 69-69 of FIG. 67 of the sixth alternative polishing wheel depicted in FIGS. 66-68, in accordance with the fourteenth embodiment of the present invention.
Figure 70:
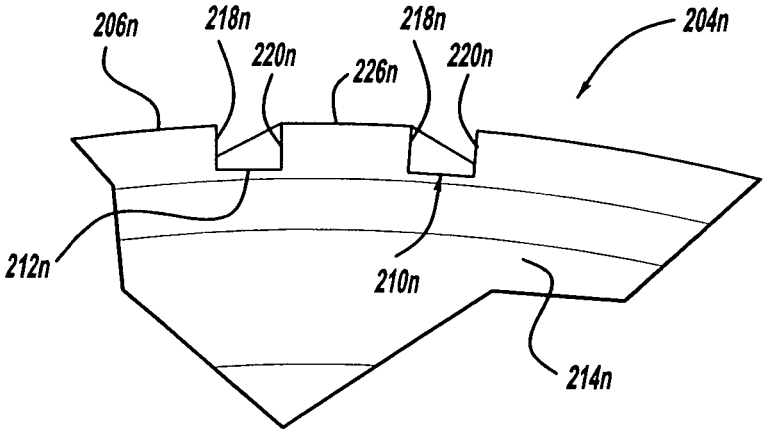
FIG. 70 is a detailed side view illustrating the swarf-clearing groove of the sixth alternative polishing wheel depicted in FIGS. 66-69, in accordance with the fourteenth embodiment of the present invention.

In accordance with a fourteenth embodiment of the present invention, there is provided a sixth alternative polishing wheel generally shown at 200*n* for polishing of an optical lens, as shown in FIGS. 66-70. Again, the intended purpose of the polishing wheel 200*n* is to, among other things, facilitate the removal of swarf material.

The polishing wheel 200*n* is similar to the rough cutting wheel 200*m* shown in FIGS. 61-65, e.g., it includes a hub portion 202*n*, an outer circumferential cutting surface 204*n* (having a width W), an abrasive grit material 206*n*, at least one pair 208*n* of substantially adjacent serpentine-shaped swarf-clearing grooves 210*n*, 212*n*, respectively, that extend across the width W of the cutting surface 204*n*, i.e., are contiguous from a first outer planar surface 214*n* to a second spaced and opposed outer planar surface 216*n* of the wheel 200*n*, wherein each of the serpentine-shaped grooves 210*n*, 212*n*, respectively, preferably has planar sides 218*n*, 220*n*, respectively, that extend substantially perpendicular to either outer planar surfaces 214*n*, 216*n*, respectively, and an optional gap 226*n* formed between the respective grooves 210*n*, 212*n*.

However, as with the embodiment shown in FIGS. 6-10, because the polishing wheel 200*n* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*n* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

Figure 71:
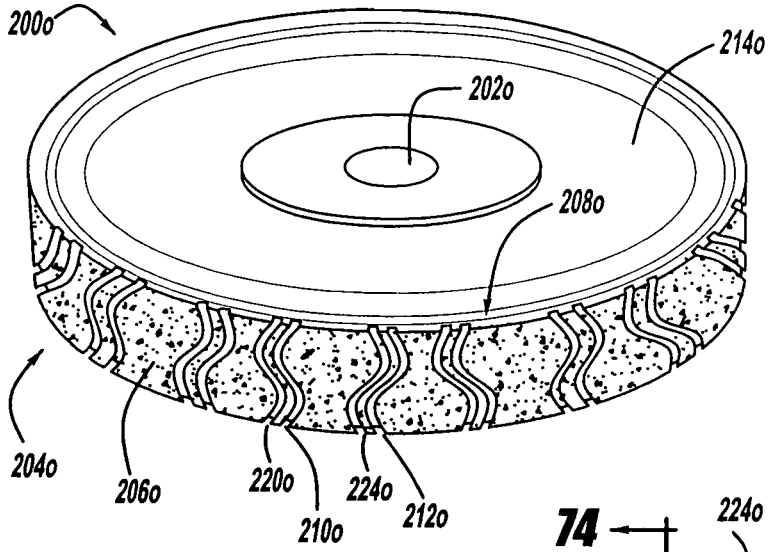
FIG. 71 is a perspective view of a seventh alternative roughing wheel, in accordance with a fifteenth embodiment of the present invention.
Figure 72:
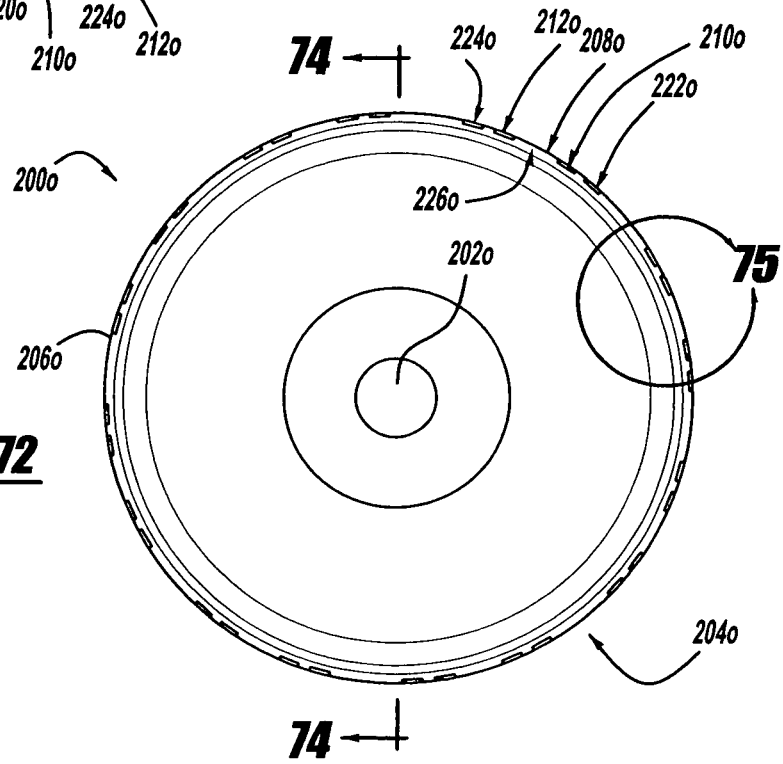
FIG. 72 is an elevational view of the seventh alternative roughing wheel depicted in FIG. 71, in accordance with the fifteenth embodiment of the present invention.
Figure 73:
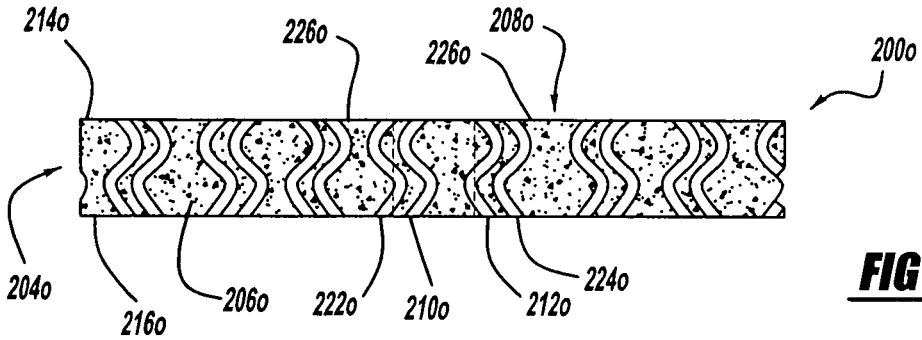
FIG. 73 is a top view of the seventh alternative roughing wheel depicted in FIGS. 71 and 72, in accordance with the fifteenth embodiment of the present invention.
Figure 74:
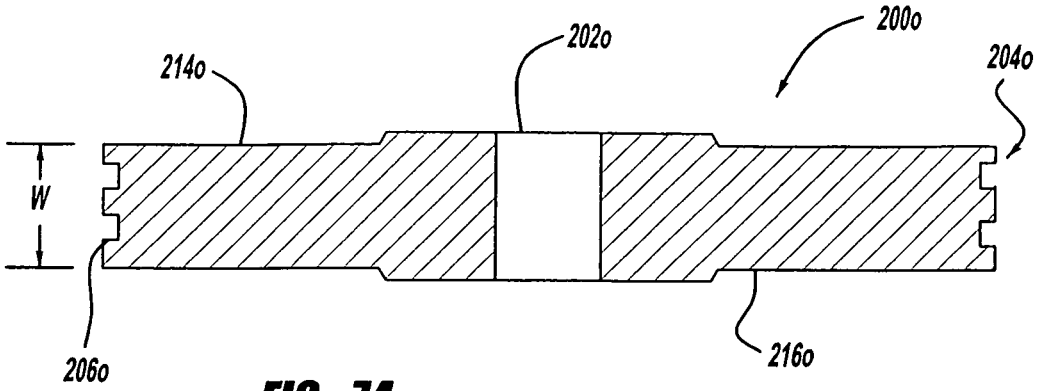
FIG. 74 is a sectional plan view taken along line 74-74 of FIG. 72 of the seventh alternative roughing wheel depicted in FIGS. 71-73, in accordance with the fifteenth embodiment of the present invention.
Figure 75:
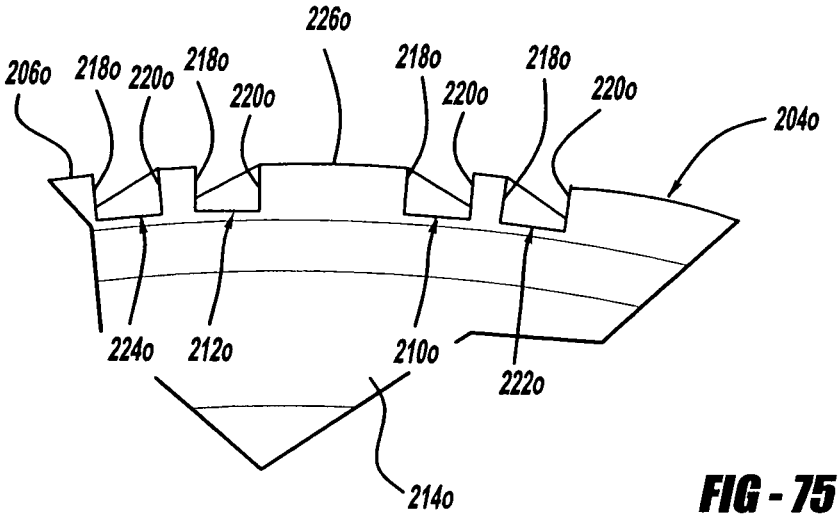
FIG. 75 is a detailed side view illustrating the swarf-clearing groove of the seventh alternative roughing wheel depicted in FIGS. 71-74, in accordance with the fifteenth embodiment of the present invention.

In accordance with a fifteenth embodiment of the present invention, there is provided a seventh alternative rough cutting wheel generally shown at 200*o* for rough cutting of an optical lens, as shown in FIGS. 71-75. Again, the intended purpose of the rough cutting wheel 200*o* is to, among other things, facilitate the removal of swarf material.

The rough cutting wheel 200*o* is similar to the rough cutting wheel 200*m* shown in FIGS. 61-65, e.g., it includes a hub portion 202*o*, an outer circumferential cutting surface 204*o* (having a width W), an abrasive grit material 206*o*, at least one pair 208*o* of substantially adjacent serpentine-shaped swarf-clearing grooves 210*o*, 212*o*, respectively, that extend across the width W of the cutting surface 204*o*, i.e., are contiguous from a first outer planar surface 214*o* to a second spaced and opposed outer planar surface 216*o* of the wheel 200*o*, wherein each of the serpentine-shaped grooves 210*o*, 212*o*, respectively, preferably has planar sides 218*o*, 220*o*, respectively, that extend substantially perpendicular to either outer planar surfaces 214*o*, 216*o*, respectively, and a gap 226*o* formed between the respective grooves 210*o*, 212*o*.

However, this embodiment differs in that two additional serpentine-shaped swarf-clearing grooves 222*o* and 224*o* respectively are provided in proximity to grooves 210*o*, 212*o*, respectively.

Figure 76:
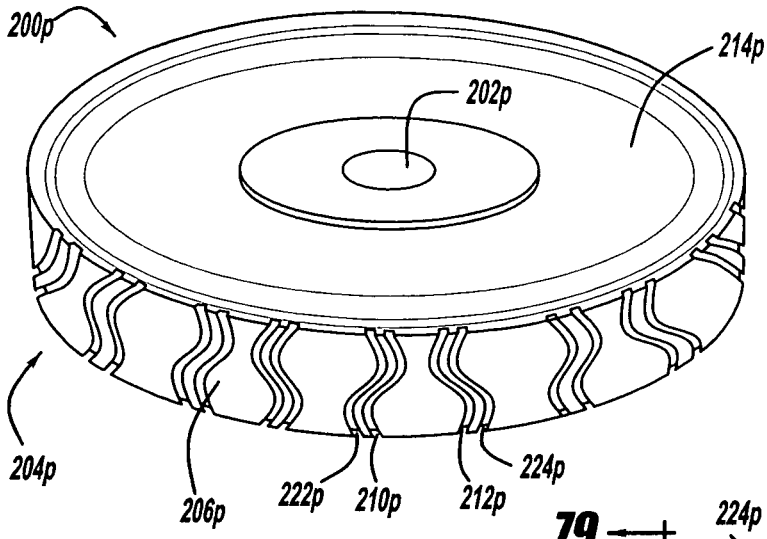
FIG. 76 is a perspective view of a seventh alternative polishing wheel, in accordance with a sixteenth embodiment of the present invention.
Figure 77:
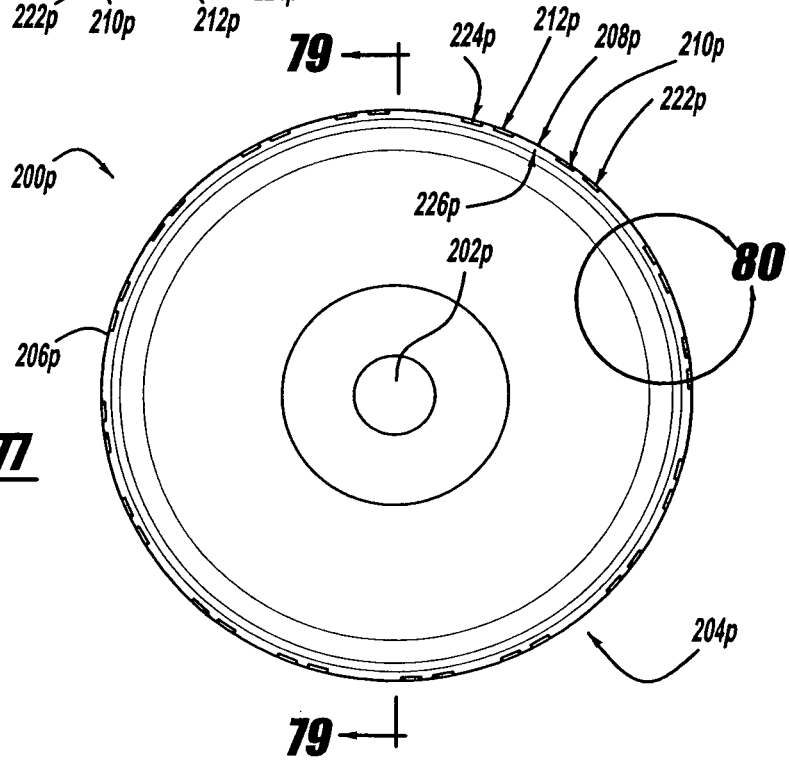
FIG. 77 is an elevational view of the seventh alternative polishing wheel depicted in FIG. 76, in accordance with the sixteenth embodiment of the present invention.
Figure 78:
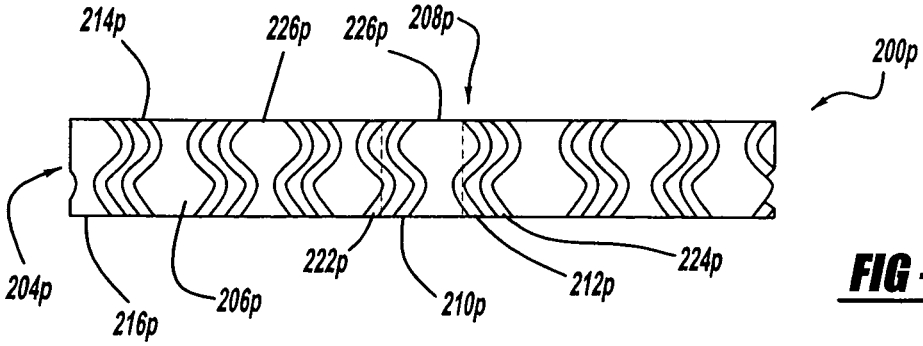
FIG. 78 is a top view of the seventh alternative polishing wheel depicted in FIGS. 76 and 77, in accordance with the sixteenth embodiment of the present invention.
Figure 79:
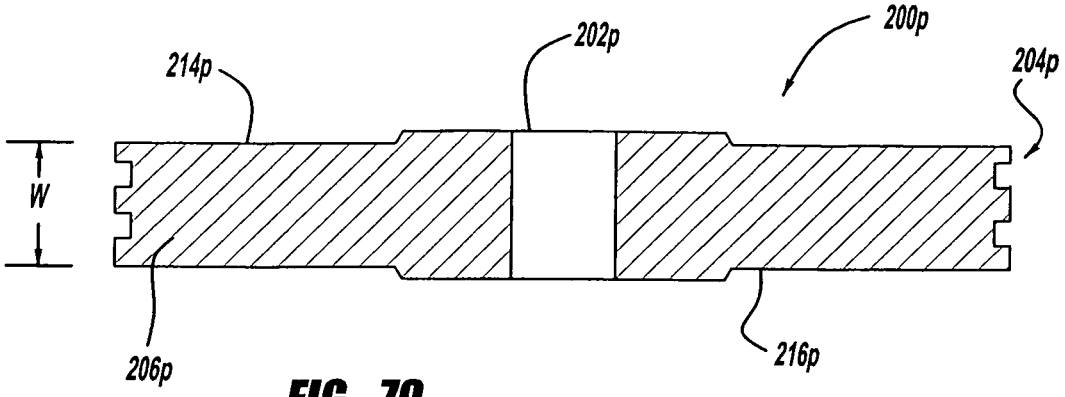
FIG. 79 is a sectional plan view taken along line 79-79 of FIG. 77 of the seventh alternative polishing wheel depicted in FIGS. 76-78, in accordance with the sixteenth embodiment of the present invention.
Figure 80:
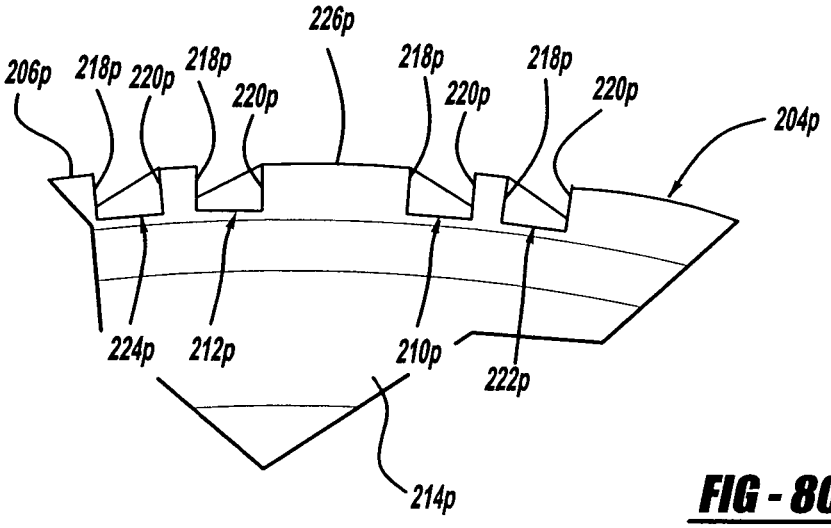
FIG. 80 is a detailed side view illustrating the swarf-clearing groove of the seventh alternative polishing wheel depicted in FIGS. 76-79, in accordance with the sixteenth embodiment of the present invention.

In accordance with a sixteenth embodiment of the present invention, there is provided a seventh alternative polishing wheel generally shown at 200*p* for polishing of an optical lens, as shown in FIGS. 76-80. Again, the intended purpose of the polishing wheel 200*p* is to, among other things, facilitate the removal of swarf material.

The polishing wheel 200*p* is similar to the rough cutting wheel 200*o* shown in FIGS. 71-75, e.g., it includes a hub portion 202*p*, an outer circumferential cutting surface 204*p* (having a width W), an abrasive grit material 206*p*, at least one pair 208*p* of substantially adjacent serpentine-shaped swarf-clearing grooves 210*p*, 212*p*, 222*p*, 224*p*, respectively, that extend across the width W of the cutting surface 204*p*, i.e., are contiguous from a first outer planar surface 214*p* to a second spaced and opposed outer planar surface 216*p* of the wheel 200*p*, wherein each of the serpentine-shaped grooves 210*p*, 212*p*, 222*p*, 224*p*, respectively, preferably has planar sides 218*p*, 220*p*, respectively, that extend substantially perpendicular to either outer planar surfaces 214*p*, 216*p*, respectively, and an optional gap 226*p* formed between the respective grooves 210*p*, 212*p*.

However, as with the embodiment shown in FIGS. 6-10, because the polishing wheel 200*p* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*p* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

Figure 81:
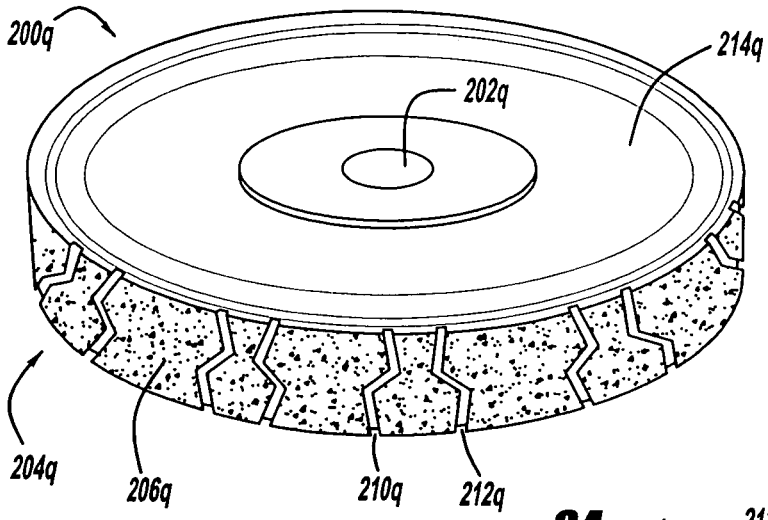
FIG. 81 is a perspective view of an eighth alternative roughing wheel, in accordance with a seventeenth embodiment of the present invention.
Figure 82:
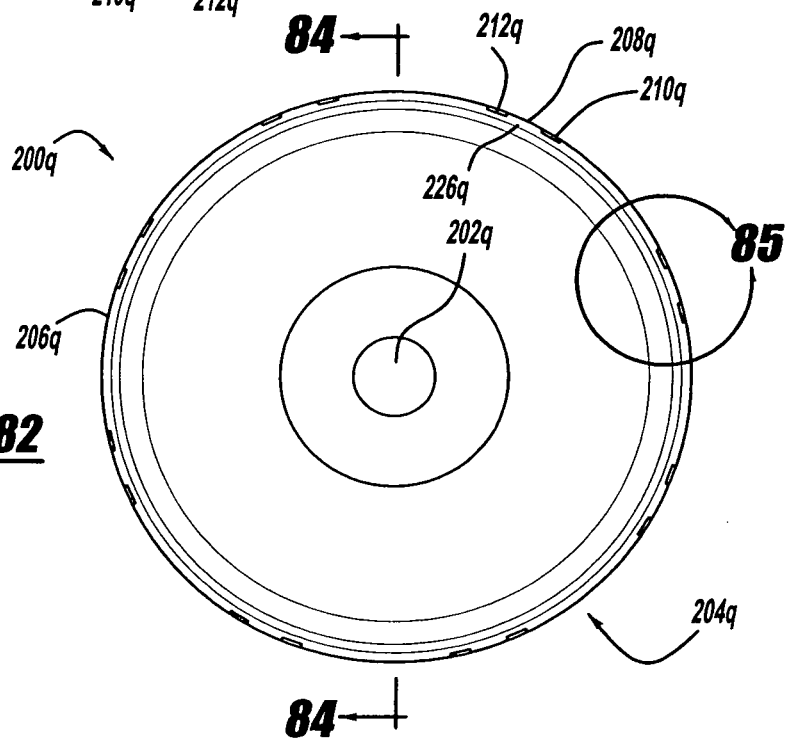
FIG. 82 is an elevational view of the eighth alternative roughing wheel depicted in FIG. 81, in accordance with the seventeenth embodiment of the present invention.
Figure 83:
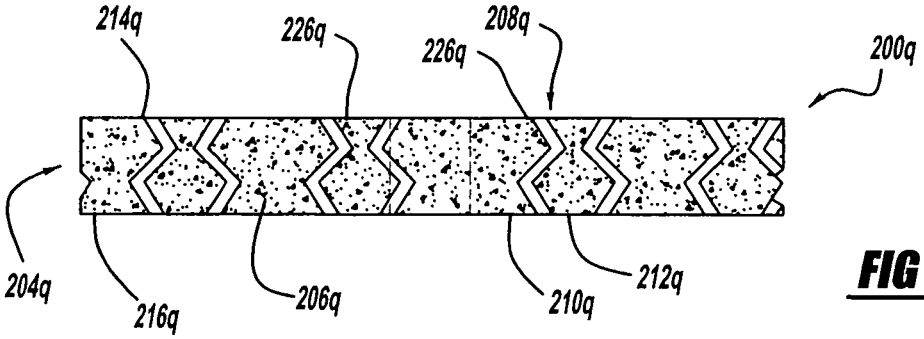
FIG. 83 is a top view of the eighth alternative roughing wheel depicted in FIGS. 81 and 82, in accordance with the seventeenth embodiment of the present invention.
Figure 84:
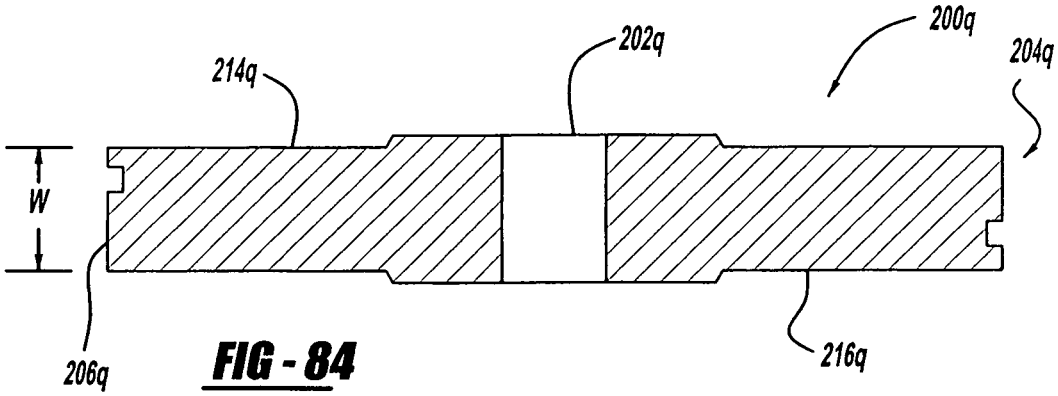
FIG. 84 is a sectional plan view taken along line 84-84 of FIG. 82 of the eighth alternative roughing wheel depicted in FIGS. 81-83, in accordance with the seventeenth embodiment of the present invention.
Figure 85:
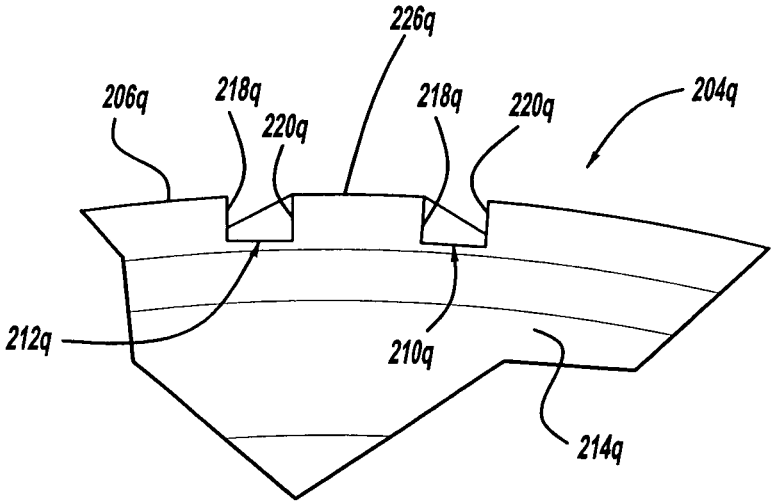
FIG. 85 is a detailed side view illustrating the swarf-clearing groove of the eighth alternative roughing wheel depicted in FIGS. 81-84, in accordance with the seventeenth embodiment of the present invention.

In accordance with a seventeenth embodiment of the present invention, there is provided an eighth alternative rough cutting wheel generally shown at 200*q* for rough cutting of an optical lens, as shown in FIGS. 81-85. Again, the intended purpose of the rough cutting wheel 200*q* is to, among other things, facilitate the removal of swarf material.

The rough cutting wheel 200*q* is similar to the rough cutting wheel 200*m* shown in FIGS. 61-65, e.g., it includes a hub portion 202*q*, an outer circumferential cutting surface 204*q* (having a width W), an abrasive grit material 206*q*, at least one pair 208*q* of substantially adjacent swarf-clearing grooves 210*q*, 212*q*, respectively, that extend across the width W of the cutting surface 204*q*, i.e., are contiguous from a first outer planar surface 214*q* to a second spaced and opposed outer planar surface 216*q* of the wheel 200*q*, wherein each of the grooves 210*q*, 212*q*, respectively, preferably has planar sides 218*q*, 220*q*, respectively, that extend substantially perpendicular to either outer planar surfaces 214*q*, 216*q*, respectively, and an optional gap 226*q* formed between the respective grooves 210*q*, 212*q*.

However, this embodiment differs in that the grooves 210*q* and 212*q*, respectively, are substantially zigzagged in configuration, as opposed to being gradually curved.

Figure 86:
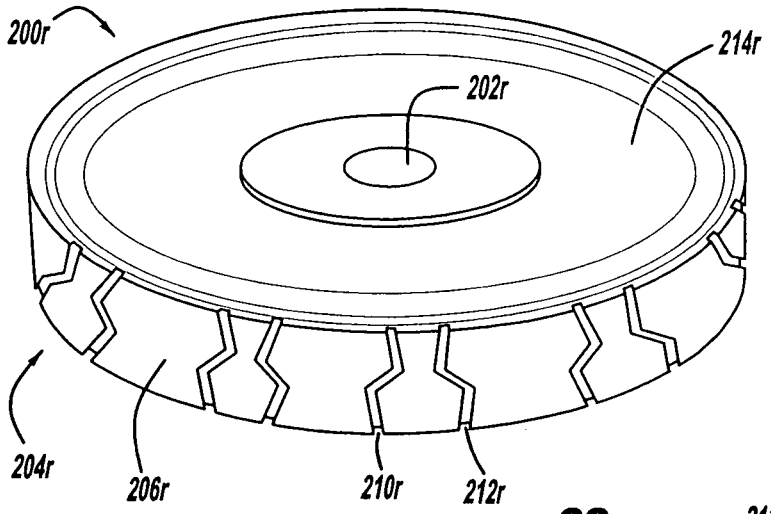
FIG. 86 is a perspective view of an eighth alternative polishing wheel, in accordance with an eighteenth embodiment of the present invention.
Figure 87:
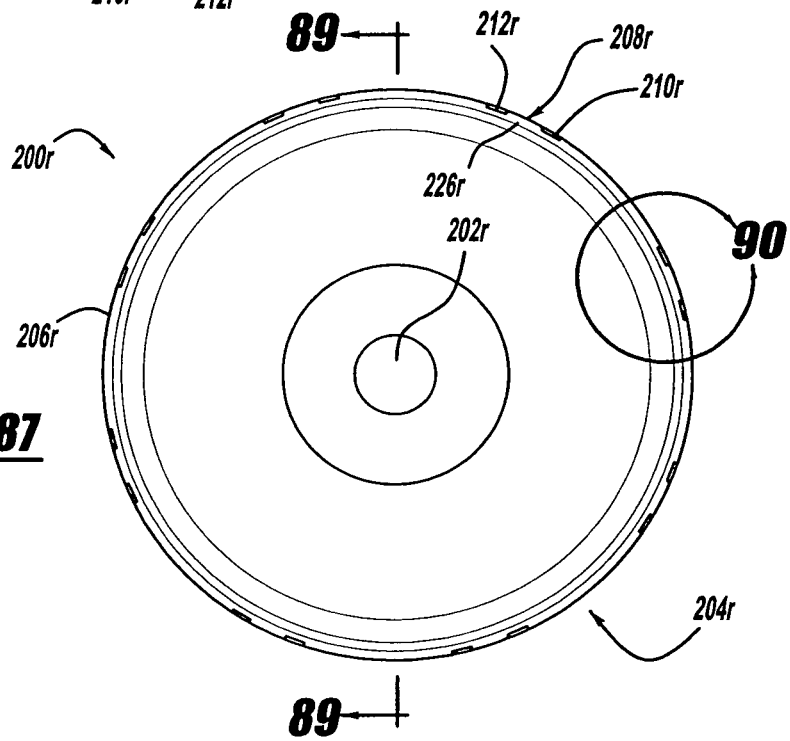
FIG. 87 is an elevational view of the eighth alternative polishing wheel depicted in FIG. 86, in accordance with the eighteenth embodiment of the present invention.
Figure 88:
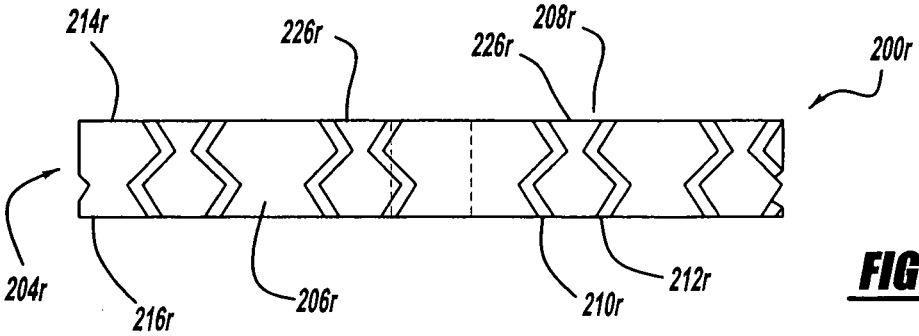
FIG. 88 is a top view of the eighth alternative polishing wheel depicted in FIGS. 86 and 87, in accordance with the eighteenth embodiment of the present invention.
Figure 89:
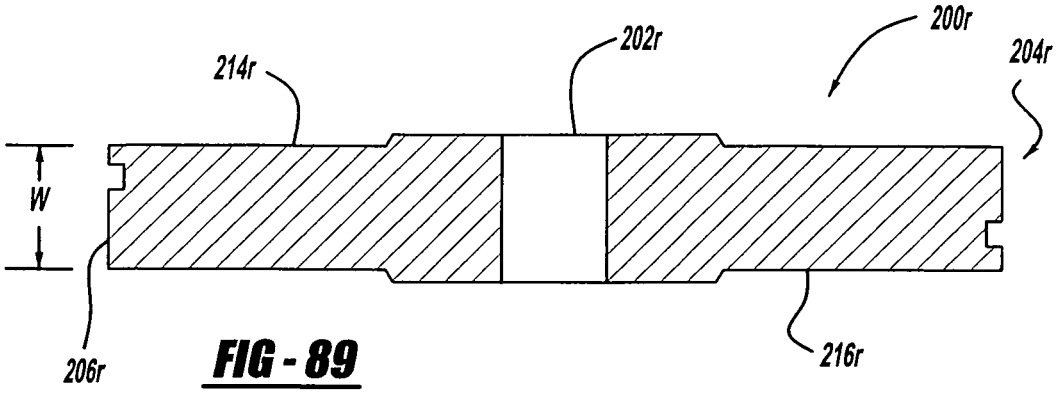
FIG. 89 is a sectional plan view taken along line 89-89 of FIG. 87 of the eighth alternative polishing wheel depicted in FIGS. 86-88, in accordance with the eighteenth embodiment of the present invention.
Figure 90:
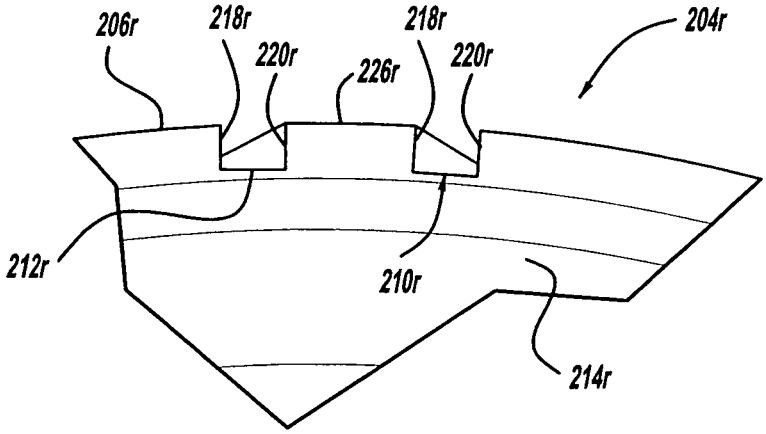
FIG. 90 is a detailed side view illustrating the swarf-clearing groove of the eighth alternative polishing wheel depicted in FIGS. 86-89, in accordance with the eighteenth embodiment of the present invention.

In accordance with an eighteenth embodiment of the present invention, there is provided an eighth alternative polishing wheel generally shown at 200*r* for polishing of an optical lens, as shown in FIGS. 86-90. Again, the intended purpose of the polishing wheel 200*r* is to, among other things, facilitate the removal of swarf material.

The polishing wheel 200*r* is similar to the rough cutting wheel 200*q* shown in FIGS. 81-85, e.g., it includes a hub portion 202*r*, an outer circumferential cutting surface 204*r* (having a width W), an abrasive grit material 206*r*, at least one pair 208*r* of substantially adjacent zigzagged-shaped swarf-clearing grooves 210*r*, 212*r*, respectively, that extend across the width W of the cutting surface 204*r*, i.e., are contiguous from a first outer planar surface 214*r* to a second spaced and opposed outer planar surface 216*r* of the wheel 200*r*, wherein each of the zigzagged-shaped grooves 210*r*, 212*r*, respectively, preferably has planar sides 218*r*, 220*r*, respectively, that extend substantially perpendicular to either outer planar surfaces 214*r*, 216*r*, respectively, and an optional gap 226*r* formed between the respective grooves 210*r*, 212*r*.

However, as with the embodiment shown in FIGS. 6-10, because the polishing wheel 200*r* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*r* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

Figure 91:
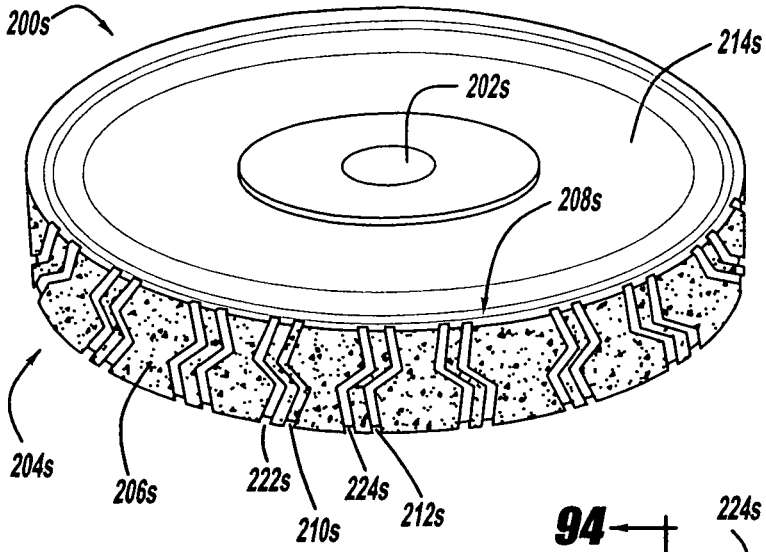
FIG. 91 is a perspective view of a ninth alternative roughing wheel, in accordance with a nineteenth embodiment of the present invention.
Figure 92:
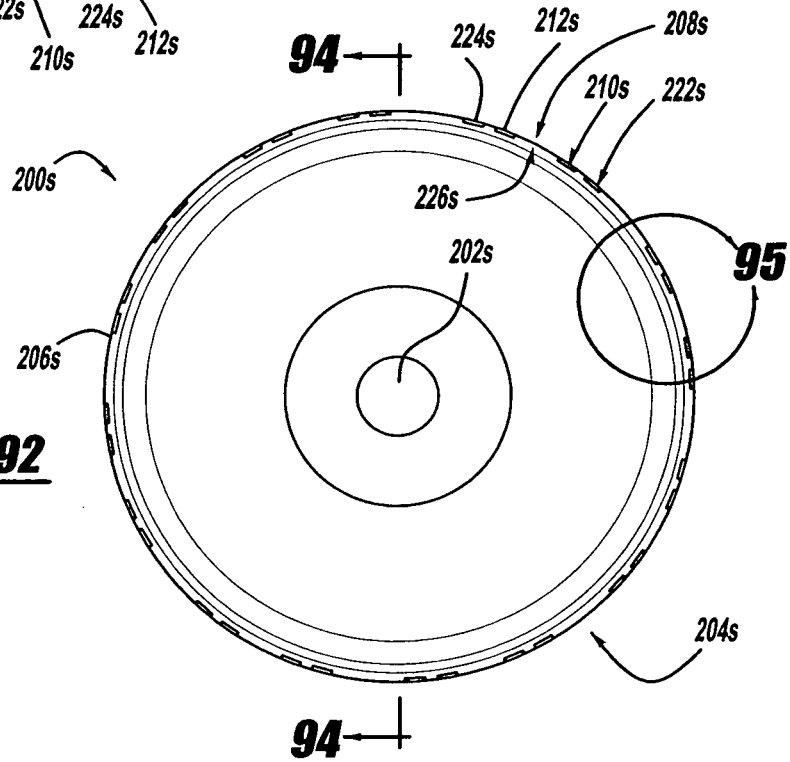
FIG. 92 is an elevational view of the ninth alternative roughing wheel depicted in FIG. 91, in accordance with the nineteenth embodiment of the present invention.
Figure 93:
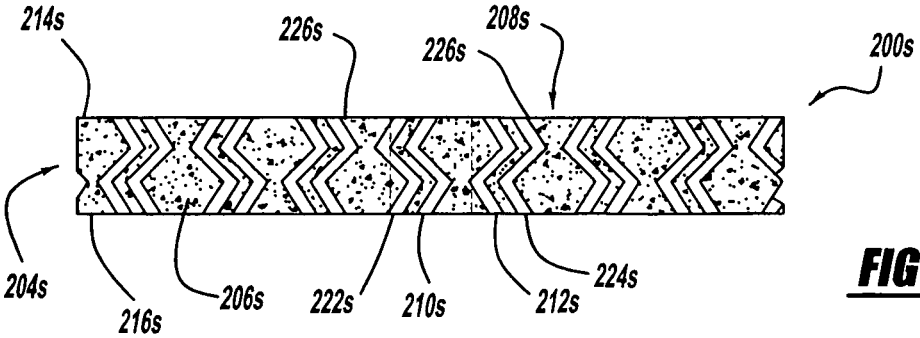
FIG. 93 is a top view of the ninth alternative roughing wheel depicted in FIGS. 91 and 92, in accordance with the nineteenth embodiment of the present invention.
Figure 94:
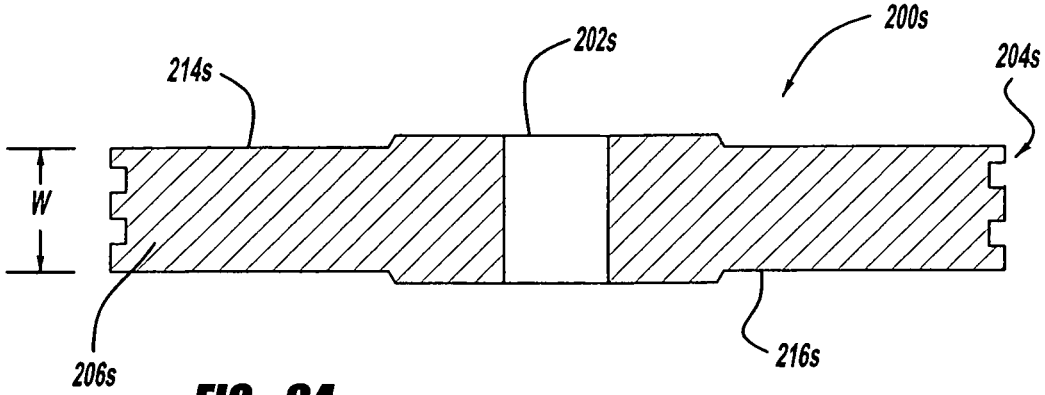
FIG. 94 is a sectional plan view taken along line 94-94 of FIG. 92 of the ninth alternative roughing wheel depicted in FIGS. 91-93, in accordance with the nineteenth embodiment of the present invention.
Figure 95:
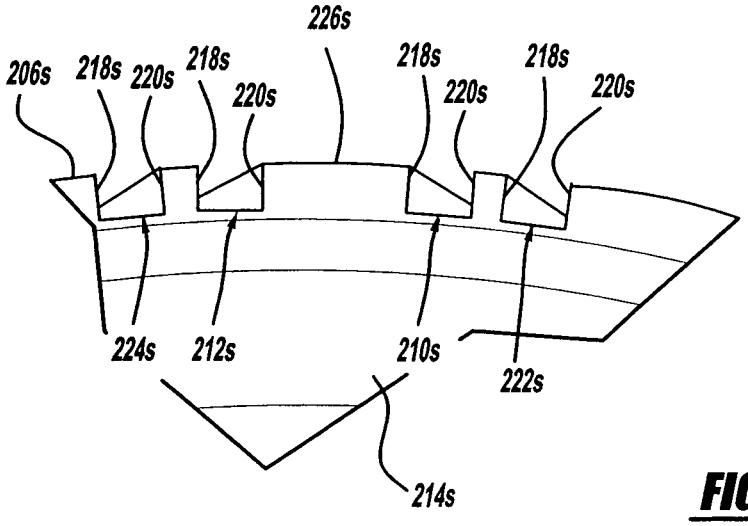
FIG. 95 is a detailed side view illustrating the swarf-clearing groove of the ninth alternative roughing wheel depicted in FIGS. 91-94, in accordance with the nineteenth embodiment of the present invention.

In accordance with a nineteenth embodiment of the present invention, there is provided a ninth alternative rough cutting wheel generally shown at 200*s* for rough cutting of an optical lens, as shown in FIGS. 91-95. Again, the intended purpose of the rough cutting wheel 200*s* is to, among other things, facilitate the removal of swarf material.

The rough cutting wheel 200*s* is similar to the rough cutting wheel 200*q* shown in FIGS. 81-85, e.g., it includes a hub portion 202*s*, an outer circumferential cutting surface 204*s* (having a width W), an abrasive grit material 206*s*, at least one pair 208*s* of substantially adjacent zigzagged-shaped swarf-clearing grooves 210*s*, 212*s*, respectively, that extend across the width W of the cutting surface 204*s*, i.e., are contiguous from a first outer planar surface 214*s* to a second spaced and opposed outer planar surface 216*s* of the wheel 200*s*, wherein each of the serpentine-shaped grooves 210*q*, 212*s*, respectively, preferably has planar sides 218*s*, 220*s*, respectively, that extend substantially perpendicular to either outer planar surfaces 214*s*, 216*s*, respectively, and a gap 226*s* formed between the respective grooves 210*s*, 212*s*.

However, this embodiment differs in that two additional zigzagged-shaped swarf-clearing grooves 222*s* and 224*s* respectively are provided in proximity to grooves 210*s*, 212*s*, respectively.

Figure 96:
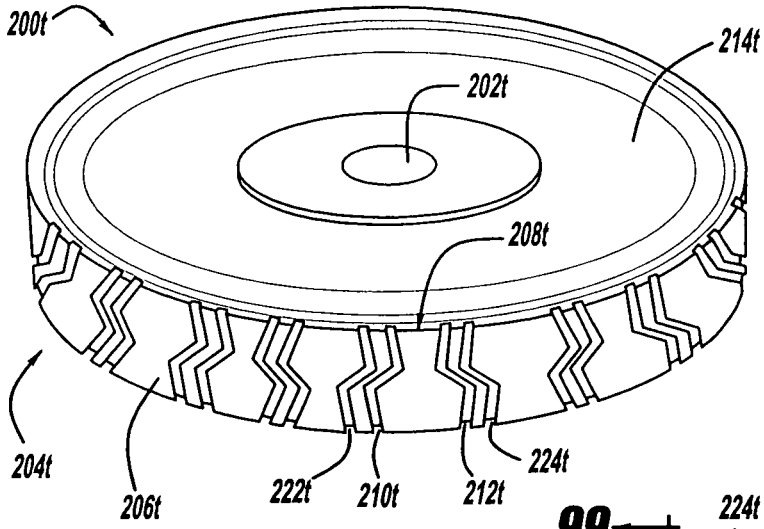
FIG. 96 is a perspective view of a ninth alternative polishing wheel, in accordance with a twentieth embodiment of the present invention.
Figure 97:
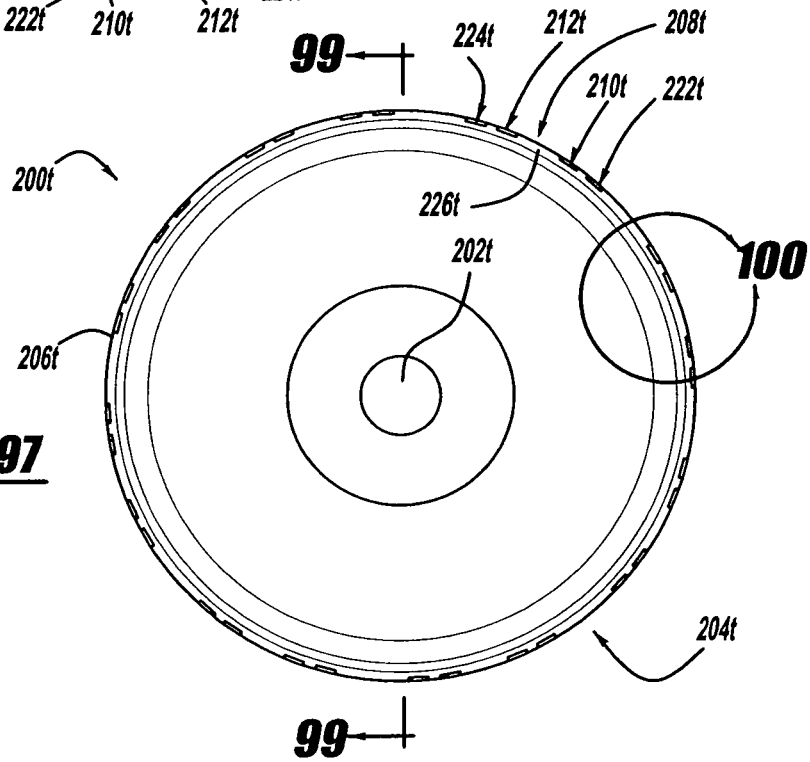
FIG. 97 is an elevational view of the ninth alternative polishing wheel depicted in FIG. 96, in accordance with the twentieth embodiment of the present invention.
Figure 98:
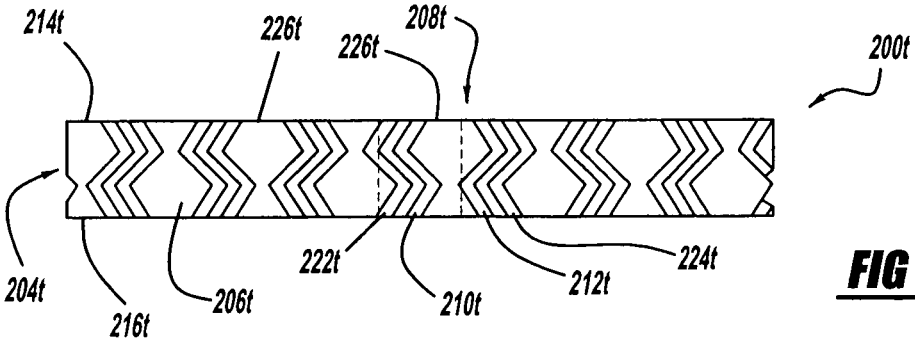
FIG. 98 is a top view of the ninth alternative polishing wheel depicted in FIGS. 96 and 97, in accordance with the tenth embodiment of the present invention.
Figure 99:
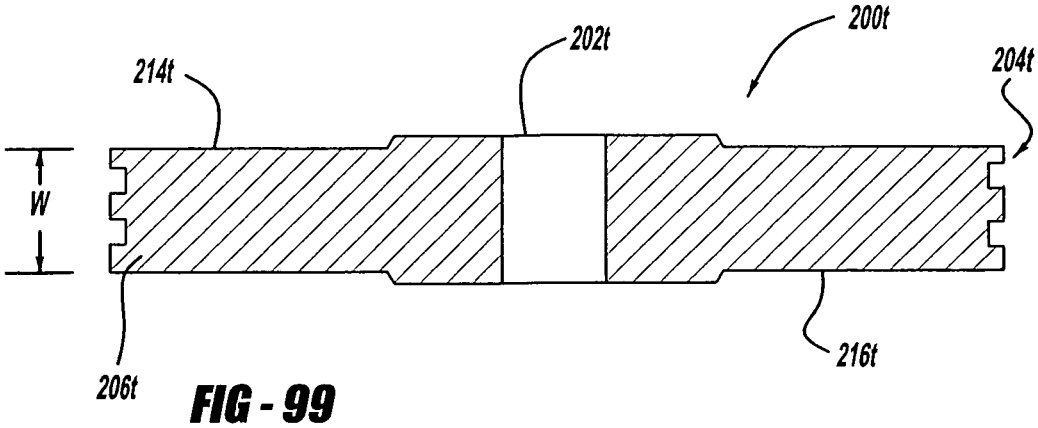
FIG. 99 is a sectional plan view taken along line 99-99 of FIG. 97 of the ninth alternative polishing wheel depicted in FIGS. 96-98, in accordance with the tenth embodiment of the present invention.
Figure 100:
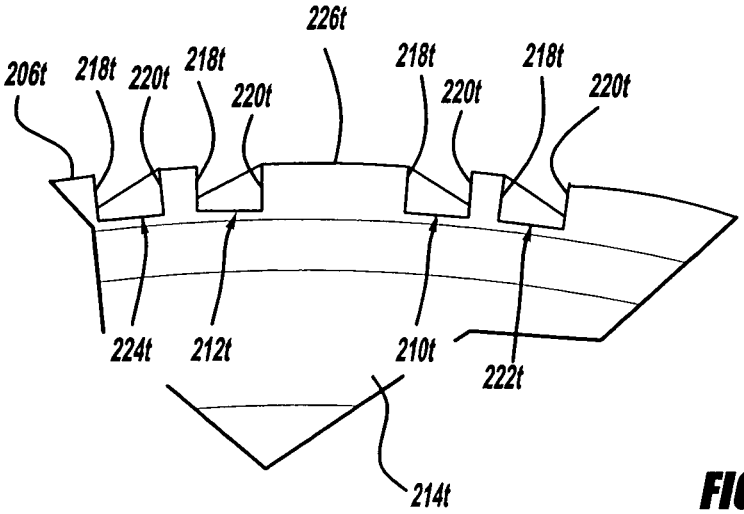
FIG. 100 is a detailed side view illustrating the swarf-clearing groove of the ninth alternative polishing wheel depicted in FIGS. 96-99, in accordance with the twentieth embodiment of the present invention.

In accordance with a twentieth embodiment of the present invention, there is provided a ninth alternative polishing wheel generally shown at 200*t* for polishing of an optical lens, as shown in FIGS. 96-100. Again, the intended purpose of the polishing wheel 200*t* is to, among other things, facilitate the removal of swarf material.

The polishing wheel 200*t* is similar to the rough cutting wheel 200*s* shown in FIGS. 91-95, e.g., it includes a hub portion 202*t*, an outer circumferential cutting surface 204*t* (having a width W), an abrasive grit material 206*t*, at least one pair 208*t* of substantially adjacent zigzagged-shaped swarf-clearing grooves 210*t*, 212*t*, 222*t*, 224*t*, respectively, that extend across the width W of the cutting surface 204*t*, i.e., are contiguous from a first outer planar surface 214*t* to a second spaced and opposed outer planar surface 216*t* of the wheel 200*t*, wherein each of the zigzagged-shaped grooves 210*t*, 212*t*, 222*t*, 224*t*, respectively, preferably has planar sides 218*t*, 220*t*, respectively, that extend substantially perpendicular to either outer planar surfaces 214*t*, 216*t*, respectively, and an optional gap 226*t* formed between the respective grooves 210*t*, 212*t*.

However, as with the embodiment shown in FIGS. 6-10, because the polishing wheel 200*t* is intended for fine grinding and/or polishing of the optical lens, it is instead preferred to use an abrasive grit material that is much finer and thus less abrasive than the abrasive grit material 206 used for the rough cutting wheel 200. In accordance with a preferred embodiment of the present invention, the grit rating of the abrasive grit material 206*t* is preferably in the range of about 80 to about 600. It should be appreciated that grit rating outside of these ranges, i.e., less than 80 and/or greater than 600, may be used as well in the practice of the present invention, should circumstances require (e.g., material specific requirements).

It should also be appreciated that other configurations may be employed with the grooves of the present invention. By way of a non-limiting example, crisscross or "X-shaped" patterns can be used as well in the practice of the present invention.

The use of the described wheels, whether for rough cutting, fine grinding, finishing, polishing, beveling, or the like, is fairly straightforward. The wheel is preferably mounted to a rotary motion machine, which preferably allows the wheel to selectively rotate about an axis, wherein at least a portion of the cutting face is accessible (e.g., by a work piece such as an optical lens blank). The wheel is then rotated while an optical lens blank is brought into contact with the rotating wheel for a sufficient period of time. As swarf material is generated by the frictional engagement, the swarf material is preferably carried away from the surface of the optical lens blank and/or the wheel by the swarf-clearing grooves of the present invention. It will be appreciated that the choice of wheel will be dependent, in part, on the particular action to be carried out, e.g., rough cutting, fine grinding, finishing, polishing, beveling, or the like. Thus, in the production of a particular finished optical lens, it may be necessary to employ multiple types of wheels, e.g., one for rough cuffing, one for fine grinding, one for finishing, one for polishing, one for beveling, and so forth, to perform the required cutting, grinding, finishing, polishing, or beveling functions.

Testing of the wheels of the present invention have shown an increase in the ease of swarf material removal during the grinding process, a reduction in the number of burrs on the edge surfaces of the optical lens blanks, a reduction in grinding noise levels, and a reduction in odor levels due to the grinding process. Additionally, wheels of the present invention cut cool enough to allow grinding of TRIVEX™ and polycarbonate lens materials substantially without melting. The present invention allows cooler cutting and improved edge finishing qualities whether in rough cutting, finish cutting or polishing operations.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

What is claimed is:

1. A rotary edging wheel for rough cutting of an optical lens, comprising:

a hub portion operable for attachment to a rotary power source, wherein said hub portion includes a substantially solid body member;

radially extending first and second outer planar surface portions;

an outer circumferential rough cutting surface having a width, wherein said surface is adjacent to said body member, said surface including an abrasive grit in a single layer bonded thereto by brazing, wherein said abrasive grit is operable for rough cutting of optical lens blanks of high index plastic, polycarbonate, CR39 and Trivex material, wherein said abrasive grit is present at a substantially level depth across the width of said surface and has a grit rating of about 20 to about 80; and at least one pair of substantially adjacent swarf clearing grooves formed in said surface, comprising:

a first swarf clearing groove extending at an angle across the width of said surface;

a second swarf clearing groove extending at an angle across the width of said surface;

wherein said first and second swarf clearing grooves are angled either towards each other or away from each other and extend continuously across said surface and open into said first and second outer planar surface portions; and wherein said first and second swarf clearing grooves are operable to remove swarf out through said first and second outer planar surface portions during a substantially cool rough cutting operation that is dry.

2. The invention of claim 1, further comprising a plurality of pairs of substantially adjacent swarf clearing grooves formed in said surface.

3. The invention of claim 1, wherein each groove has an angle of from about 10 degrees to about 80 degrees.

4. The invention of claim 1, wherein each groove has an angle of from about 15 degrees to about 65 degrees.

5. The invention of claim 1, wherein each groove has an angle of from about 35 degrees to about 45 degrees.

6. The invention of claim 1, wherein said abrasive grit is comprised of diamond hardness grit.

7. The invention of claim 1, wherein each groove has an angle of from about 91 degrees to about 179 degrees.

8. A rotary edging wheel for polishing of an optical lens, comprising:

a hub portion operable for attachment to a rotary power source, wherein said hub portion includes a substantially solid body member;

radially extending first and second outer planar surface portions; an outer circumferential cutting surface having a width, wherein said surface is adjacent to said body member, said surface including an abrasive grit in a single layer bonded thereto by brazing, wherein said abrasive grit is operable for polishing of optical lens blanks of high index plastic, polycarbonate, CR39 and Trivex material, wherein said abrasive grit is present at a substantially level depth across the width of said surface and has a grit rating of about 80 to about 600; and at least one pair of substantially adjacent swarf clearing grooves formed in said surface, comprising:

a first swarf clearing groove extending at an angle across the entire width of said surface;

a second swarf clearing groove extending at an angle across the entire width of said surface;

wherein said first and second swarf clearing grooves are angled either towards each other or away from each other and extend continuously across said surface and open into said first and second outer planar surface portions; and wherein said first and second swarf clearing grooves are operable to remove swarf out through said first and second outer planar surface portions during a substantially cool polishing operation that is dry.

9. The invention of claim 8, further comprising a plurality of pairs of substantially adjacent swarf clearing grooves formed in said surface.

10. The invention of claim 8, wherein each groove has an angle of from about 10 degrees to about 80 degrees.

11. The invention of claim 8, wherein each groove has an angle of from about 15 degrees to about 65 degrees.

12. The invention of claim 8, wherein each groove has an angle of from about 35 degrees to about 45 degrees.

13. The invention of claim 8, wherein said abrasive grit is comprised of diamond hardness grit.

14. The invention of claim 8, wherein each groove has an angle of from about 91 degrees to about 179 degrees.

15. A method for rough cutting of an optical lens, comprising:

providing an edging wheel, comprising:

a hub portion operable for attachment to a rotary power source, wherein said hub portion includes a substantially solid body member;

radially extending first and second outer planar surface portions; an outer circumferential rough cutting surface having a width, wherein said surface is adjacent to said body member, said surface including an abrasive grit in a single layer bonded thereto by brazing, wherein said abrasive grit is operable for rough cutting of optical lens blanks of high index plastic, polycarbonate, CR39 and Trivex material, wherein said abrasive grit is present at a substantially level depth across the width of said surface and has a grit rating of about 60 to about 70; and at least one pair of substantially adjacent swarf clearing grooves formed in said surface, comprising:

a first swarf clearing groove extending at an angle across the entire width of said surface; and a second swarf clearing groove extending at an angle across the entire width of said surface;

wherein said first and second swarf clearing grooves are angled either towards each other or away from each other and extend continuously across said surface and opening into said first and second outer planar surface portions;

wherein said first and second swarf clearing grooves are operable to remove swarf during a substantially cool rough cutting operation that is dry; selectively rotating said edging wheel; bringing the optical lens blank into selective contact with said rotating edging wheel;

selectively forming an edge finish on the optical lens blank during a substantially cool rough cutting operation; and removing swarf along said first and second swarf clearing grooves out through said first and second outer planar surface portions.

16. A method for polishing of an optical lens, comprising:

providing a rotary edging wheel, comprising:

a hub portion operable for attachment to a rotary power source, wherein said hub portion includes a substantially solid body member;

radially extending first and second outer planar surface portions;

an outer circumferential cutting surface having a width, wherein said surface is adjacent to said body member, said surface including an abrasive grit in a single layer bonded thereto by brazing, wherein said abrasive grit is operable for polishing of optical lens blanks of high index plastic, polycarbonate, CR39 and Trivex material, wherein said abrasive grit is present at a substantially level depth across the width of said surface and has a grit rating of about 80 to about 600; and at least one pair of substantially adjacent swarf clearing grooves formed in said surface, comprising:

a first swarf clearing groove extending at an angle across the entire width of said surface; and a second swarf clearing groove extending at an angle across the entire width of said surface;

wherein said at least one pair of substantially adjacent swarf clearing grooves have planar sides that extend the entire width of said surface substantially perpendicular to either said first and second outer planar surface portions;

wherein said first and second swarf clearing grooves are angled either towards each other or away from each other and extend continuously across said surface and open into said first and second outer planar surface portions;

wherein said first and second swarf clearing grooves are operable to remove swarf during a substantially cool polishing operation that is dry;

selectively rotating said edging wheel;

bringing the optical lens blank of high index plastic, polycarbonate, CR39 or Trivex material into selective contact with said rotating edging wheel;

selectively forming an edge finish on the optical lens blank during a substantially cool polishing operation; and removing swarf along said first and second swarf clearing grooves out through said first and second outer planar surface portions.

* * * * *